US012543859B2

(12) United States Patent
Hervol

(10) Patent No.: US 12,543,859 B2
(45) Date of Patent: Feb. 10, 2026

(54) ERGONOMIC CHAIR

(71) Applicant: Kinetik Solutions, LLC, Wilmington, DE (US)

(72) Inventor: Cameron Hervol, Chandler, AZ (US)

(73) Assignee: KINETIK SOLUTIONS, LLC, Wilmington, DE (US)

( * ) Notice: Subject to any disclaimer, the term of this patent is extended or adjusted under 35 U.S.C. 154(b) by 114 days.

(21) Appl. No.: 18/372,014

(22) Filed: Sep. 22, 2023

(65) Prior Publication Data

US 2025/0098863 A1 Mar. 27, 2025

(51) Int. Cl.

| | |
|---|---|
| ***A47C 7/44*** | (2006.01) |
| ***A47C 7/00*** | (2006.01) |
| *A47C 7/02* | (2006.01) |

(52) U.S. Cl.

CPC ..... *A47C 7/445* (2013.01); *A47C 7/006* (2013.01); *A47C 7/443* (2013.01); *A47C 7/444* (2018.08); *A47C 7/024* (2013.01)

(58) Field of Classification Search

CPC ..... A47C 7/024; A47C 7/444; A47C 7/443
See application file for complete search history.

(56) References Cited

U.S. PATENT DOCUMENTS 2,272,980 A 2/1942 McLellan
4,685,730 A * 8/1987 Linguanotto ..... A47C 1/03255 297/316
4,765,679 A * 8/1988 Lanuzzi ..... A47C 1/03283 297/312 X
5,597,203 A * 1/1997 Hubbard ..... A47C 7/024 297/301.1
6,695,403 B1 * 2/2004 Su ..... A47C 5/06 297/284.7
6,761,406 B2 * 7/2004 Kinoshita ..... A47C 7/16 297/296 X
6,811,215 B2 * 11/2004 Horiki ..... A47C 7/46 297/284.4 X
6,913,316 B2 * 7/2005 Kinoshita ..... A47C 1/03216 297/301.1

(Continued)

FOREIGN PATENT DOCUMENTS

CN 201029630 Y 3/2008
CN 110973883 A 4/2020

(Continued)

*Primary Examiner* — Rodney B White
(74) *Attorney, Agent, or Firm* — BRYAN CAVE LEIGHTON PAISNER LLP

(57) ABSTRACT

An apparatus can comprise a base mount, a linkage frame, a first linkage arm, and a second linkage arm. The linkage frame can include a first end and a second end; the first end of the linkage frame can be coupled to the base mount; and the linkage frame can include a cam plate positioned between the first end and the second end. The first linkage arm can include a first end and a second end; the second end of the first linkage arm can be rotatably coupled to the second end of the linkage frame; and the first linkage arm can include a cavity. The second linkage arm can include a first end and a second end; the second end of the second linkage arm can be coupled to the first linkage arm; and the second linkage arm can be positioned in the cavity of the first linkage arm. Other embodiments are disclosed.

20 Claims, 14 Drawing Sheets

(56) References Cited

U.S. PATENT DOCUMENTS

| | | | | |
|---|---|---|---|---|
| 7,134,722 | B2 * | 11/2006 | Ueda | A47C 7/462 297/301.1 |
| 7,195,583 | B2 * | 3/2007 | Leib | A47C 7/506 482/52 |
| 7,350,865 | B2 * | 4/2008 | Pearse | A47C 7/144 297/312 |
| 7,387,339 | B2 * | 6/2008 | Bykov | A47C 7/024 297/312 X |
| 7,396,079 | B2 * | 7/2008 | Heidmann | A47C 7/46 297/285 |
| 7,416,253 | B2 * | 8/2008 | Kim | A47C 7/029 297/312 |
| 7,422,287 | B2 * | 9/2008 | Heidmann | A47C 7/444 297/285 |
| 7,434,879 | B2 * | 10/2008 | Ueda | A47C 7/4454 297/296 X |
| 7,717,513 | B2 * | 5/2010 | Ueda | A47C 7/444 297/300.2 |
| 7,866,750 | B2 * | 1/2011 | Bock | A47C 7/443 297/303.3 |
| 8,272,691 | B2 * | 9/2012 | Hsuan-Chin | A47C 7/46 297/285 |
| 8,944,507 | B2 * | 2/2015 | Goetz | A47C 9/005 297/321 |
| 9,498,066 | B2 * | 11/2016 | Christianson | A47C 7/445 |
| 10,058,180 | B2 * | 8/2018 | Desanta | A47C 1/03255 |
| 10,226,129 | B2 * | 3/2019 | Christianson | A47C 1/026 |
| 10,765,218 | B2 * | 9/2020 | Donati | A47C 7/40 |
| 10,973,725 | B2 * | 4/2021 | Mason | A47C 7/024 |
| 11,596,232 | B2 * | 3/2023 | Goetz | A47C 7/14 |
| 11,805,905 | B2 * | 11/2023 | Goetz | A47C 7/46 |
| 11,844,440 | B2 * | 12/2023 | Schüller | A47C 7/402 |
| 2001/0008348 | A1 | 7/2001 | Nelson | |
| 2008/0265641 | A1 | 10/2008 | Kim | |
| 2010/0301652 | A1 * | 12/2010 | Ballendat | A47C 7/405 297/285 |
| 2013/0113252 | A1 * | 5/2013 | Kuenzler | A47C 9/002 297/284.3 |
| 2013/0234484 | A1 * | 9/2013 | Pan | A47C 7/443 297/285 |
| 2014/0132051 | A1 | 5/2014 | Freedman | |
| 2015/0173515 | A1 * | 6/2015 | Freedman | A47C 7/443 297/313 |

FOREIGN PATENT DOCUMENTS

| | | | |
|---|---|---|---|
| KR | 101705335 | B1 | 2/2017 |
| WO | 2020165852 | A1 | 8/2020 |

* cited by examiner

ERGONOMIC CHAIR

TECHNICAL FIELD

This disclosure relates generally to chairs, and more particularly to an ergonomic chair and its methods of use and manufacture.

BACKGROUND

A majority of office workers spend their working day sitting down at a desk, often in chairs that offer little support. Over time, this lack of support can lead to chronic pain, discomfort, and/or poor posture. These issues can result in a range of health problems, including back pain, neck pain, and shoulder pain. In an attempt to mitigate these issues and problems, there have been numerous attempts to create chairs that provide proper support to the human body.

BRIEF DESCRIPTION OF THE DRAWINGS

To facilitate further description of the embodiments, the following drawings are provided in which.

Figure 1:
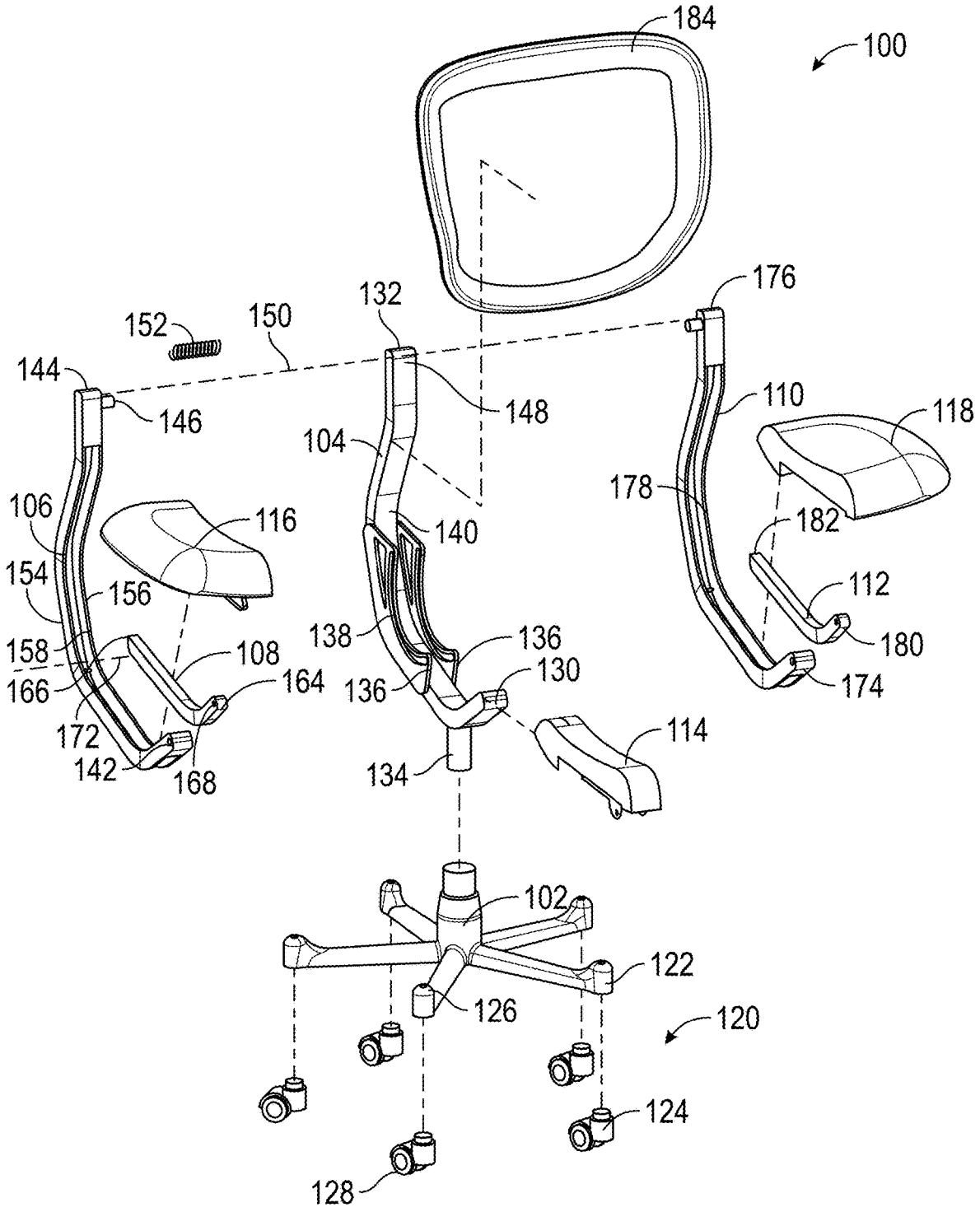
FIG. 1 illustrates an exploded view of an exemplary chair, according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DESCRIPTION OF EXAMPLES OF EMBODIMENTS

Various embodiments are directed to an ergonomic chair. Embodiments disclosed herein are directed to an ergonomic chair that can alleviate back pain and improve posture by enabling a user to perform a stretching movement by sliding their leg underneath and behind the chair. Embodiments, disclosed herein incorporate a linkage frame mechanism with a pivotable seat mechanism that enables the user to move the seat, creating a space underneath the chair to enable to user to perform the stretching movement. This space allows the user to position their leg underneath and behind the chair, thereby alleviating pressure on the lower back and promoting a more ergonomic posture. As used herein, "stretching movement" refers to a user remaining in a seated position with one foot on the ground and extending their other leg behind them in a kneeling position with a portion of their foot touching the ground and their knee elevated above the ground to at least stretch the user's lower back.

Embodiments disclosed herein address the common problem of prolonged sitting in office chairs, which can lead to back pain and other musculoskeletal issues. Traditional office chairs offer limited adjustability, often leading to an unnatural seating position that puts pressure on the lower back and hips. Embodiments disclosed herein are directed to a significant improvement over existing chairs by improving ergonomics and reducing factors associated with the risk of back pain.

As evidenced by this disclosure, the ergonomic chair can be customizable, with a range of adjustable features that allow the user to tailor the chair to their specific needs. The pivotable linkage frame and pivotable seat mechanism is intuitive to use and can be adjusted with minimal effort, allowing the user to quickly and easily perform a stretching movement in chair for maximum comfort.

The ergonomic chair disclosed herein can be used in a variety of settings, including offices, homes, and other environments. Embodiments disclosed herein can assist individuals who spend a significant amount of time sitting down and are at risk of developing back pain or other musculoskeletal issues, and other individuals who desire to maintain a healthy lifestyle.

As an example of the embodiments described above, an apparatus can comprise a base mount, a linkage frame, a first linkage arm, and a second linkage arm. The linkage frame can include a first end and a second end; the first end of the linkage frame can be coupled to the base mount; and the linkage frame can include a cam plate positioned between the first end and the second end. The first linkage arm can include a first end and a second end; the second end of the first linkage arm can be rotatably coupled to the second end of the linkage frame; and the first linkage arm can include a cavity. The second linkage arm can include a first end and a second end; the second end of the second linkage arm can be coupled to the first linkage arm; and the second linkage arm can be positioned in the cavity of the first linkage arm.

As another example of the embodiments described above, a chair can comprise a linkage frame, a first seat portion, a backrest, a first linkage arm, a second linkage arm, and a second seat portion. The linkage frame can include a first end, a second end, and a cam plate positioned between the first end and the second end, and the cam plate can include a radial cam rail mechanism extending along at least a portion of a length of the cam plate. The first seat portion can be coupled to the first end of the linkage frame. The backrest can be coupled to the second end of the linkage frame. The first linkage arm can include a first end and a second end; the second end of the first linkage arm can be rotatably coupled to the second end of the linkage frame; and the first linkage arm including a cavity. The second linkage arm can include a first end and a second end; the second end of the second linkage arm can be coupled to the first linkage arm; and the second linkage arm can be positioned in the cavity of the first linkage arm. The second seat portion can be coupled to the first end of the first linkage arm, can be coupled to the first end of the second linkage arm, and can be configured to move along the radial cam rail mechanism.

As a further example of the embodiments described above, a method of manufacturing an apparatus can comprise: providing a linkage frame including a first end and a second end; providing a first seat portion coupled to the first end of the linkage frame; providing a backrest coupled to the second end of the linkage frame; providing a first linkage arm including a first end and a second end, the first end of the first linkage arm coupled to the second end of the linkage frame; providing a second linkage arm including a first end and a second end, the first end of the second linkage arm coupled to the first end of the first linkage arm; and providing a second seat portion coupled to the first seat portion, the first end of the first linkage arm and the first end of the second linkage arm coupled to the second seat portion.

Turning to the drawings, FIG. 1 illustrates an exemplary chair 100 in an exploded view. The chair 100 of the illustrated embodiment comprises a base mount 102, a linkage frame 104 (which includes a cam plate radial cam as discussed in more detail below), a first linkage arm 106, second linkage arm 108, a third linkage arm 110, a fourth linkage arm 112, a first seat portion 114, a second seat portion 116, and a third seat portion 118.

In the illustrated embodiment, the base mount 102 comprises wheel assemblies 120. Each of the wheel assemblies 120 includes a housing 122 and a wheel 124 coupled to the housing 122. In some embodiments of each of the wheel assemblies 120, the wheel 124 can swivel within the housing 122 to enable the wheel 124 to maneuver when operated by a user. Each of the wheel assemblies 120 includes a first end 126 and a second end 128. As discussed in more detail below for each of the wheel assemblies 120, the first end 126 of the wheel assembly 120 and the second end 128 of the wheel assembly 120 can be sized to allow for clearance of the leg of a user of the chair 100 when the user sits in the chair 100 while a seat portion of the chair 100 moves from a starting or first position to an intermediate or second position to an ending or third position, as described herein. More specifically, when the chair 100 is fully assembled, the first ends 126 of the wheel housings 122 and the base mount 102 are positioned at least a minimum distance away from the first end 142 of the first linkage arm 106 to enable the first end 142 of the first linkage arm 106 (and the second seat portion 116) to move between the first end 130 of the linkage frame 104 and the first end 126 of at least one of the wheel housings 122 such that the leg of the user of the chair 100 can fit between the first linkage arm 106 (and the second seat portion 116) and the first end 126 of at least one of the wheel housings 122.

In the illustrated embodiment, the linkage frame 104 comprises the first end 130 and a second end 132. The linkage frame 104 comprises a coupling mechanism 134 between the first end 130 and the second end 132 (but closer to or adjacent the first end 130) of the linkage frame 104. In some embodiments, the coupling mechanism 134 can be a rod, a post, a rectangular shaft, a hole, etc. The coupling mechanism 134 of the linkage frame 104 couples the linkage frame 104 to the base mount 102. For example, the coupling mechanism 134 of the linkage frame 104 can couple the linkage frame 104 to the base mount 102 via fasteners, a ball bearing apparatus, or other coupling mechanisms to allow the linkage frame 104 to maneuver while coupled to the base mount 102.

Figure 2B:
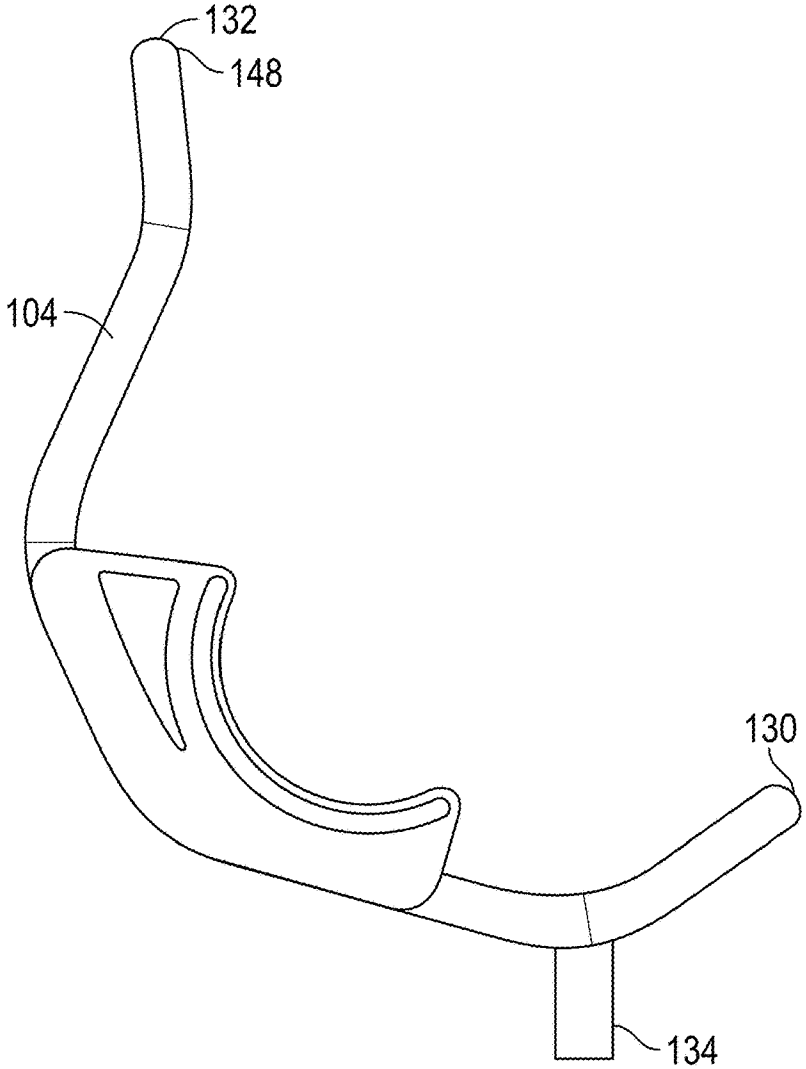
FIG. 2B illustrates another exemplary view of the linkage frame of FIG. 2A, according to an embodiment.
Figure 2A:
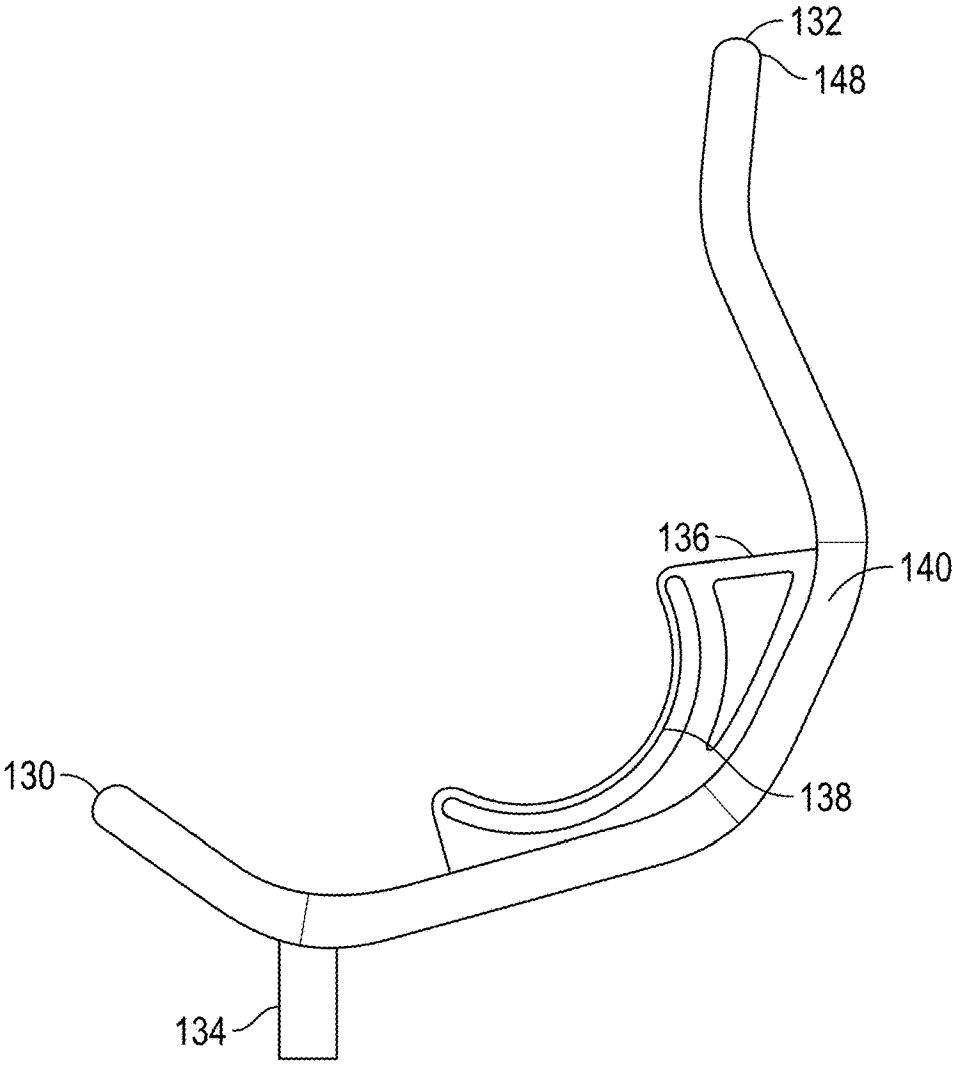
FIG. 2A illustrates an exemplary view of a linkage frame for the exemplary chair of FIG. 1, according to an embodiment.

The linkage frame 104 comprises a cam plate 136 positioned on a body 140 of the linkage frame 104 between the first end 130 of the linkage frame 104 and the second end 132 of the linkage frame 104. In some embodiments, the cam plate 136 can be coupled to the body 140 of the linkage frame 104 via a coupling mechanism (e.g., fasteners, welds, etc.), or the cam plate 136 can be formed on the body 140 of the linkage frame 104 via additive manufacturing, etc. In the illustrated embodiment, the cam plate 136 includes a radial cam rail mechanism 138 that extends along at least a portion of a length of the cam plate 136. In some embodiments, the radial cam rail mechanism 138 can extend along the length of the cam plate 136. In the illustrated embodiment, the radial cam rail mechanism 138 has a circular shape. In other embodiments, the radial cam rail mechanism 138 can have an elliptical, oval, or another curved (whether regular or irregular) shape on the cam plate 136. In the illustrated embodiment of FIG. 1, the linkage frame 104 comprises two cam plates 136, namely, one on each side of linkage frame 104. In other embodiments, the linkage frame 104 can include one cam plate 136, as shown in FIGS. 2A and 2B.

In the illustrated embodiment of FIG. 1, the first linkage arm 106 comprises a first end 142 and a second end 144. In some embodiments, the second end 144 of the first linkage arm 106 includes a first coupling mechanism 146, and the second end 132 of the linkage frame 104 includes a second coupling mechanism 148. In some embodiments, the first coupling mechanism 146 is a circumferential protrusion, and the second coupling mechanism 148 is an aperture. In such an embodiment, the circumferential protrusion of the first coupling mechanism 146 can be positioned in the aperture of the second end 132 of the linkage frame 104. In other embodiments, the first coupling mechanism 146 (e.g., a circumferential protrusion) can be formed at the second end 132 of the linkage frame 104, and the second coupling mechanism 148 (e.g., an aperture) can be positioned at the second end 144 of the first linkage arm 106. In further embodiments, the first coupling mechanism 146 of the first linkage arm 106 can be rectangular, triangular, or any other shape that extends from the second end 144 of the first linkage arm 106, and the second coupling mechanism 148 of the linkage frame 104 can have a complementary shape to the shape of the first coupling mechanism 146. In the illustrated embodiment of FIG. 1, a biasing element 152 is coupled to at least one of the first coupling mechanism 146 on the second end 144 of the first linkage arm 106 or the second coupling mechanism 148 on the second end 132 of the linkage frame 104. In some embodiments, the biasing element 152 is a torsion spring. The biasing element 152 biases the first linkage arm 106 relative to the linkage frame 104 to bias the first linkage arm 106 toward a predefined position.

The first coupling mechanism 146 on the second end 144 of the first linkage arm 106 and the second coupling mechanism 148 on the second end 132 of the linkage frame 104 rotatably couple the first linkage arm 106 to the linkage frame 104 to define a first pivot axis 150 about which the first linkage arm 106 rotates relative to the linkage frame 104.

Figure 3A:
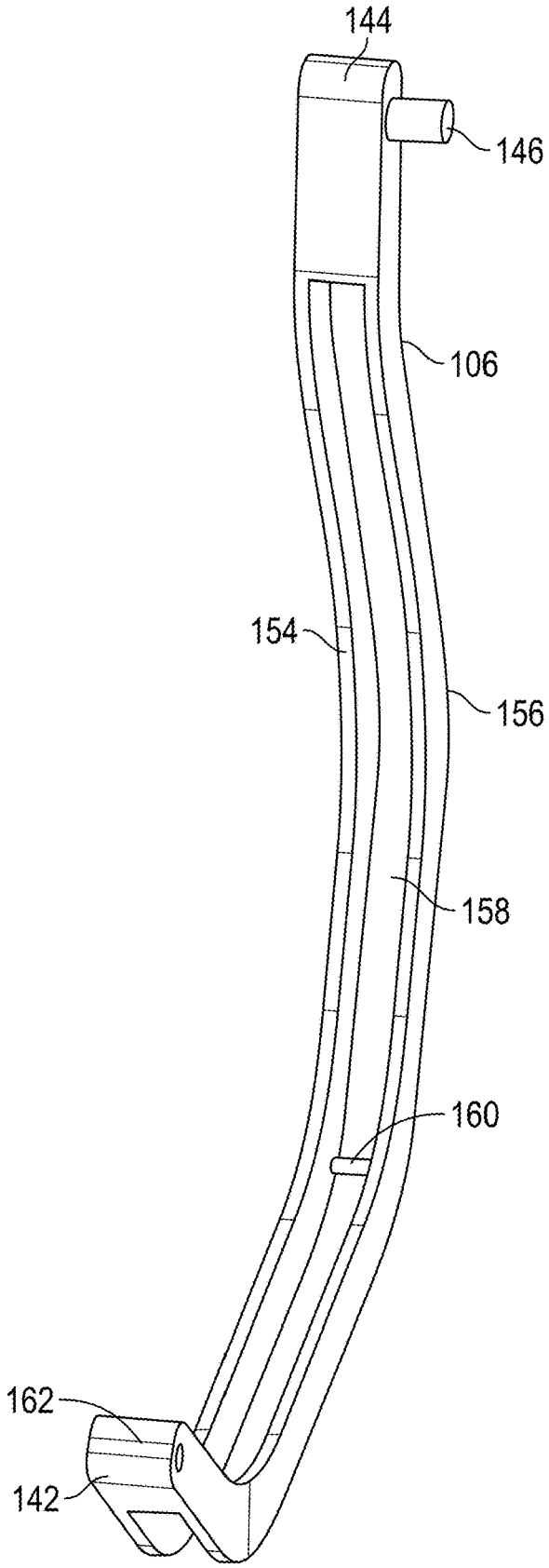
FIG. 3A illustrates an exemplary view of a first linkage arm for the exemplary chair of FIG. 1, according to an embodiment.
Figure 3B:
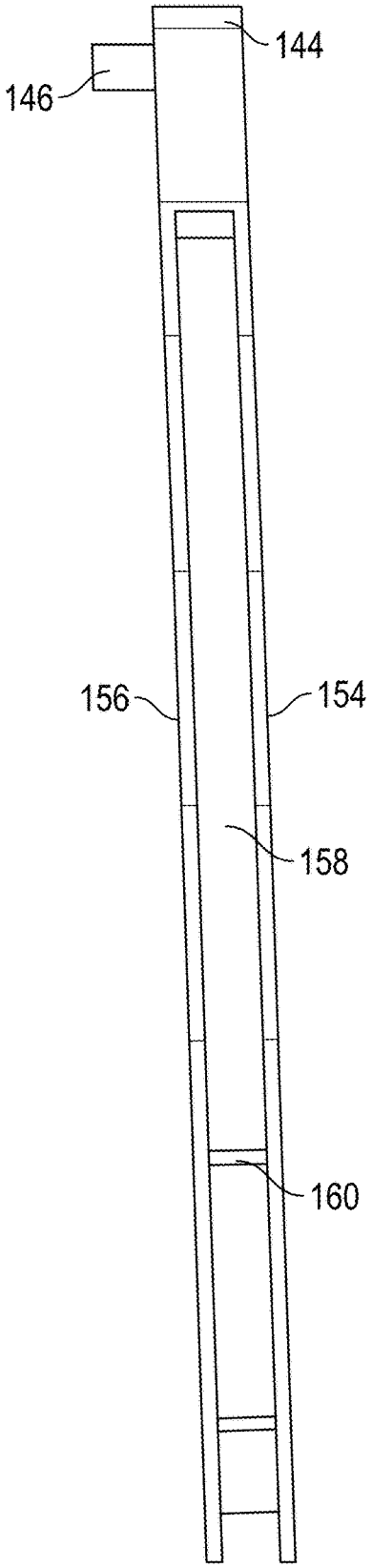
FIG. 3B illustrates another exemplary view of the first linkage arm for the exemplary chair of FIG. 1, according to an embodiment.
Figure 3C:
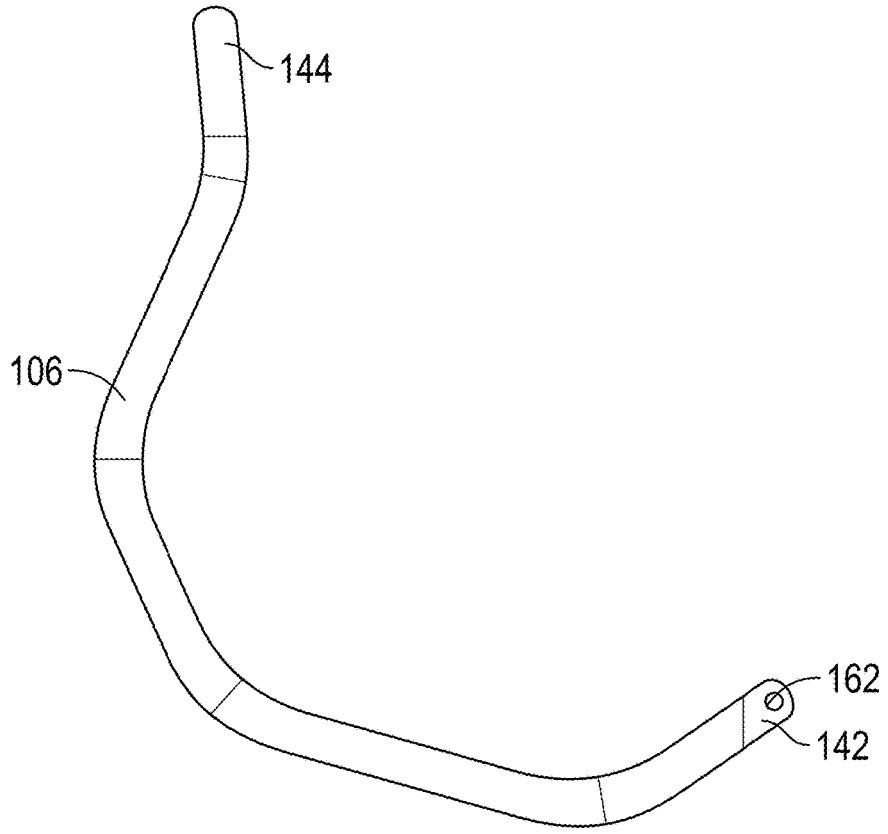
FIG. 3C illustrates another exemplary view of the first linkage arm for the exemplary chair of FIG. 1, according to an embodiment.

Turning to FIGS. 3A-3C, the first linkage arm 106 includes a first side 154 and a second side 156 that define a cavity 158. In the illustrated embodiments, the first linkage arm 106 includes a third coupling mechanism 160 (FIGS. 3A-3B) that is located between the first end 142, the second end 144, the first side 154, and the second side 156 of the first linkage arm 106 and positioned within the cavity 158. In the illustrated embodiments, the third coupling mechanism 160 (FIGS. 3A-3B) is a fastener (e.g., rod, screw). However, the third coupling mechanism 160 (FIGS. 3A-3B) can be another type of coupling mechanism. The first end 142 of the first linkage arm 106 includes a fourth coupling mechanism 162 (FIGS. 3A and 3C). In some embodiments, the fourth coupling mechanism 162 (FIGS. 3A and 3C) is an aperture. As explained in more detail below, the fourth coupling mechanism 162 (FIGS. 3A and 3C) of the first linkage arm 106 couples the first linkage arm 106 to the second seat portion 116 (FIG. 1).

Figure 4A:
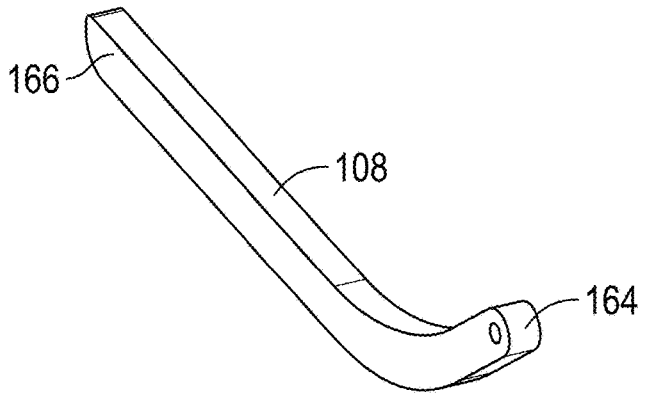
FIG. 4A illustrates an exemplary view of a second linkage arm for the exemplary chair of FIG. 1, according to an embodiment.
Figure 4B:
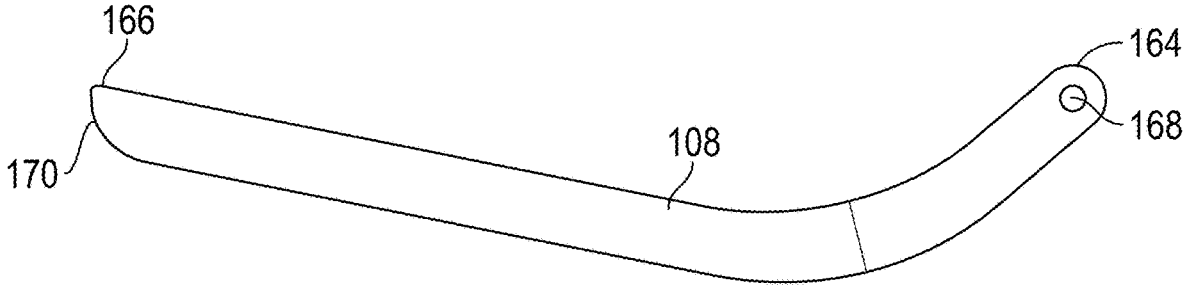
FIG. 4B illustrates another exemplary view of the second linkage arm for the exemplary chair of FIG. 1, according to an embodiment.

Turning to FIGS. 4A and 4B, the second linkage arm 108 includes a first end 164 and a second end 166. In the illustrated embodiments, the first end 164 includes a first coupling mechanism 168 (FIG. 4B) and the second end 166 includes a second coupling mechanism 170 (FIG. 4B). In some embodiments, the first coupling mechanism 168 (FIG. 4B) and the second coupling mechanism 170 (FIG. 4B) are apertures. The second linkage arm 108 is adapted to be positioned in the cavity 158 (FIGS. 1 & 3A) of the first linkage arm 106.

Figure 9B:
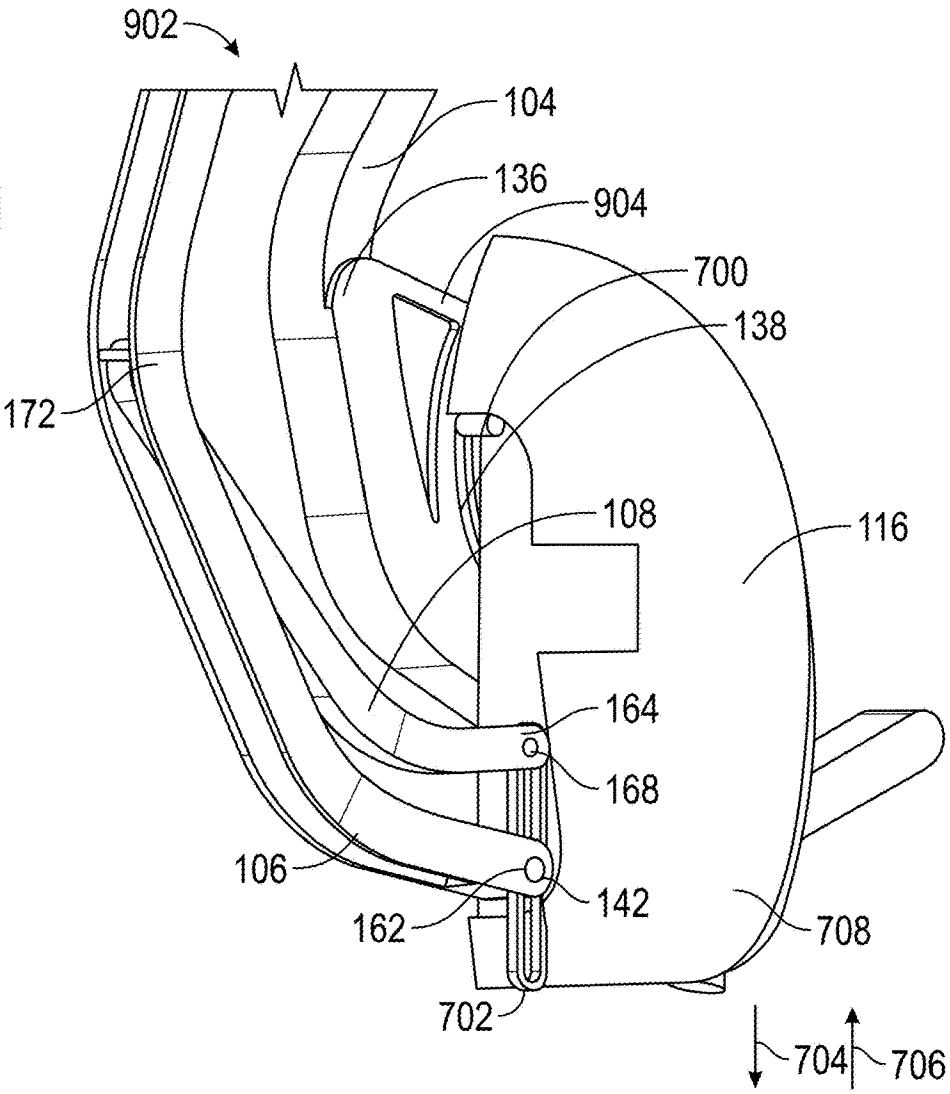
FIG. 9B illustrates an exemplary view of the exemplary chair of FIG. 1 in an operational position, according to an embodiment.

Turning briefly to FIGS. 1 and 9B, the second coupling mechanism 168 of the second linkage arm 108 couples to the third coupling mechanism 160 (FIGS. 3A-3B) of the first linkage arm 106 to define a second pivot axis 172 (FIG. 1) about which the second linkage arm 108 rotates relative to the first linkage arm 106.

Returning to FIG. 1, the third linkage arm 110 operates in a similar manner as the first linkage arm 106 as disclosed herein, and the fourth linkage arm 112 operates in a similar manner as the second linkage arm 108, as disclosed herein. For example, the third linkage arm 110 includes a first end 174 and a second end 176, and the second end 176 of the third linkage arm 110 is rotatably coupled to the second end 132 of the linkage frame 104. The third linkage arm 110 includes a cavity 178 similar to the cavity 158 of the first linkage arm 106. The fourth linkage arm 112 includes a first end 180 and a second end 182 and is positioned in the cavity 178 of the third linkage arm 110. The second end 182 of the fourth linkage arm 112 couples to the third linkage arm 110 in a similar manner as the second linkage arm 108 couples to the first linkage arm 106.

Figure 5:
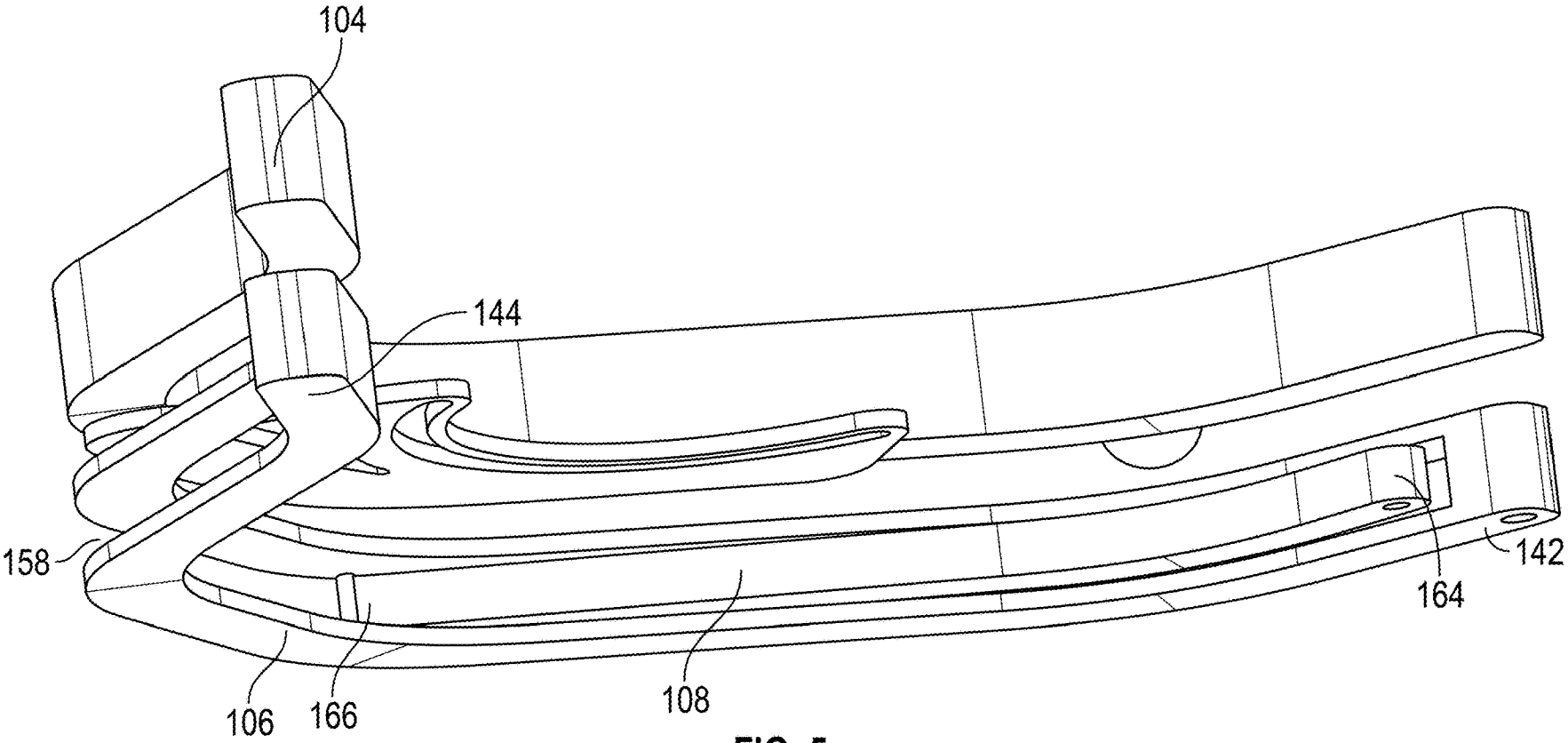
FIG. 5 illustrates an exemplary view of the linkage frame, the first linkage arm, and the second linkage arm of the exemplary chair of FIG. 1 in an assembled position, according to an embodiment.

FIG. 5 illustrates the linkage frame 104, the first linkage arm 106, and the second linkage arm 108 in an assembled position. Although not illustrated in FIG. 3A-3C, 4A-4B, or 5, in many embodiments, third linkage arm 110 (FIG. 1) and fourth linkage arm 112 (FIG. 1) are similar to first linkage arm 106 (FIG. 1) and second linkage arm 108 (FIG. 1), respectively.

Figure 6:
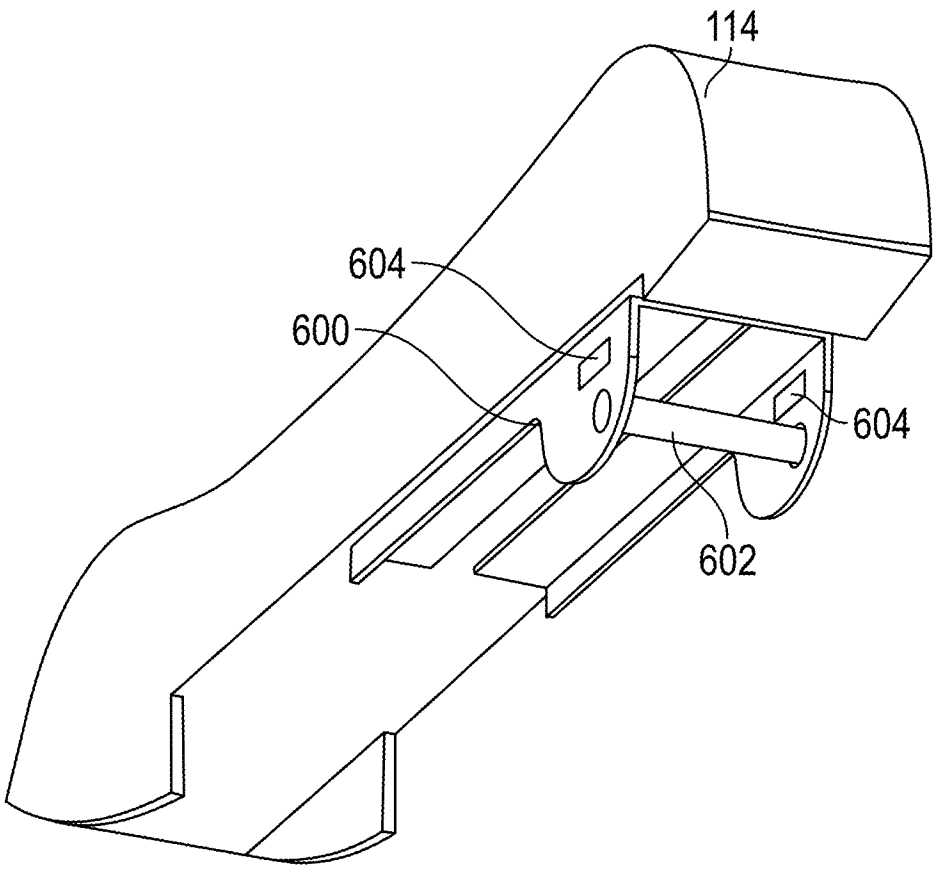
FIG. 6 illustrates an exemplary view of a first seat portion for the exemplary chair of FIG. 1, according to an embodiment.

FIG. 6 illustrates the first seat portion 114. In the illustrated embodiment of FIG. 6, the first seat portion 114 includes a bracket 600 comprising a fastener 602. The first seat portion 114 is coupled to the first end 130 (FIG. 1) of the linkage frame 104 (FIG. 1). In some embodiments, the bracket 600 of the first seat portion 114 is positioned on the first end 130 (FIG. 1) of the linkage frame 104 (FIG. 1), and the fastener 602 of the bracket 600 is positioned in the first end 130 (FIG. 1) of the linkage frame 104 (FIG. 1), thereby coupling the first seat portion 114 to the linkage frame 104 (FIG. 1). In some embodiments, the first seat portion 114 includes a latch mechanism 604 to couple the second seat portion 116 (FIG. 1) and the third seat portion 118 (FIG. 1) to the first seat portion 114. In some embodiments, the latch mechanism 604 can be a bolt lock, a lever, a snap-fit, etc. In embodiments disclosed herein, the latch mechanism 604, when disengaged from the second seat portion 116 (FIG. 1) and/or the third seat portion 118 (FIG. 1), enables the second seat portion 116 (FIG. 1) and/or the third seat portion 118 (FIG. 1), respectively, to actuate relative to the first seat portion 114. In other embodiments, the latch mechanism 604 can be positioned on the linkage frame 104 (FIG. 1) and can further couple the first linkage arm 106 (FIG. 1) and the third linkage arm 110 (FIG. 1) to the linkage frame 104 (FIG. 1). In these other embodiments, the latch mechanism 604 can be disengaged from the first linkage arm 106 (FIG. 1) and/or the third linkage arm 110 (FIG. 1) to enable the first linkage arm 106 (FIG. 1) and/or the third linkage arm 110 (FIG. 1), respectively, to actuate relative to the linkage frame 104 (FIG. 1).

Figure 7:
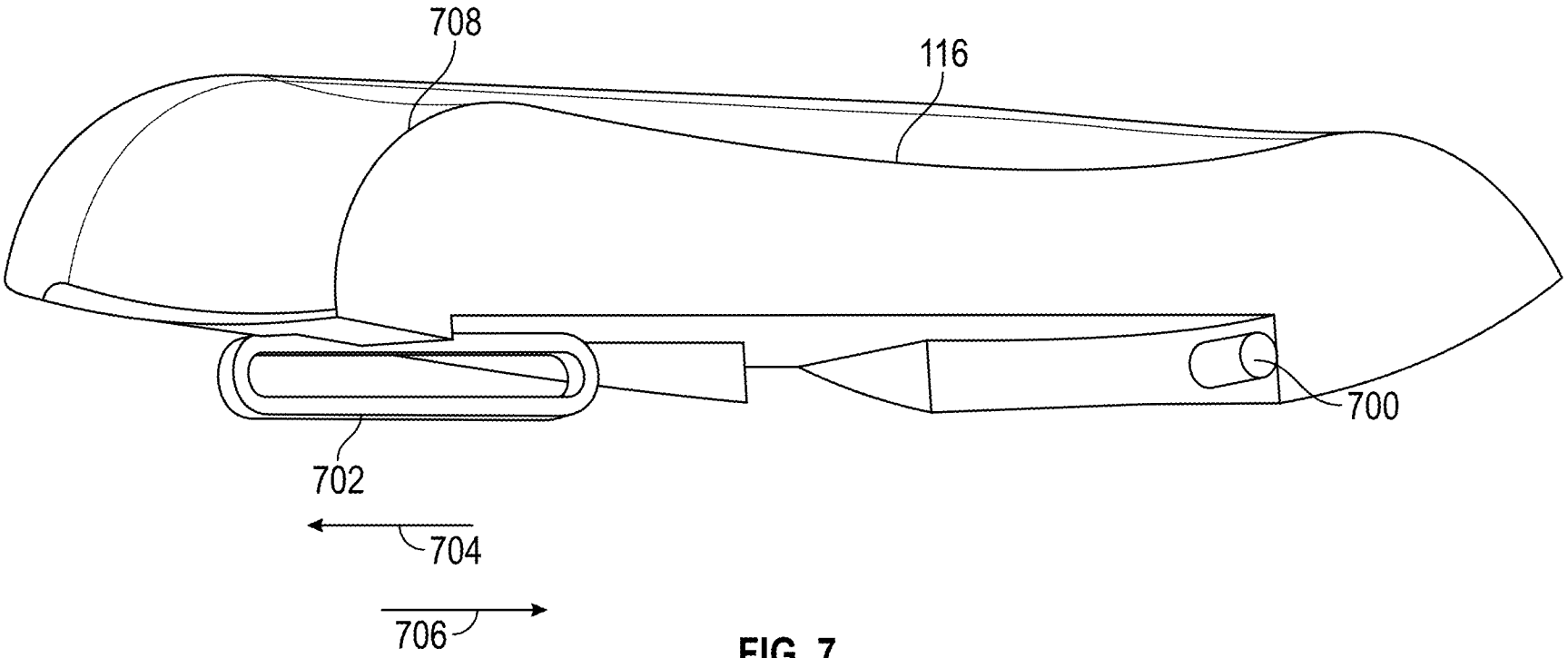
FIG. 7 illustrates an exemplary view of a second seat portion for the exemplary chair of FIG. 1, according to an embodiment.

FIG. 7 illustrates the second seat portion 116. In the illustrated embodiment, the second seat portion 116 includes a first coupling mechanism 700 and a connection mechanism 702. In the illustrated embodiment, the first coupling mechanism 700 is a post and/or a bushing-ball bearing mechanism that is coupled to the radial cam rail mechanism 138 (FIG. 1) of the cam plate 136 (FIG. 1) on the linkage frame 104 (FIG. 1). In some embodiments, the first coupling mechanism 700 of the second seat portion 116 is positioned in the radial cam rail mechanism 138 (FIG. 1) and enables the first coupling mechanism 700 to maneuver along the length of the radial cam rail mechanism 138 (FIG. 1) to allow the second seat portion 116 to move relative to the linkage frame 104 (FIG. 1) along a path having the shape of the radial cam rail mechanism 138 (FIG. 1).

In the illustrated embodiment of FIG. 7, the connection mechanism 702 is a rail positioned on the second seat portion 116. The connection mechanism 702 is adapted to receive the second coupling mechanism 162 (FIG. 3A) on the first end 142 (FIG. 3A) of the first linkage arm 106 (FIG. 3A) and the first coupling mechanism 168 (FIG. 4B) on the first end 164 (FIG. 4B) of the second linkage arm 108 (FIG. 4B). In some embodiments, the second coupling mechanism 162 (FIG. 3A) on the first end 142 (FIG. 3A) of the first linkage arm 106 (FIG. 3A) and the first coupling mechanism 168 (FIG. 4B) on the first end 164 (FIG. 4B) of the second linkage arm 108 (FIG. 4B) are coupled to the connection mechanism 702 of the second seat portion 116 via a post and/or a bushing-ball bearing mechanism to enable the first linkage arm 106 (FIG. 3A) and the second linkage arm 108 (FIG. 4B) to slide along the connection mechanism 702 of the second seat portion 116. In the illustrated embodiment, the connection mechanism 702 has circular or otherwise rounded-shaped ends. In other embodiments, the ends of the connection mechanism 702 can be rectangular, or any other shape. Although not illustrated in FIG. 7, in many embodiments, third seat portion 118 (FIG. 1) is similar to second seat portion 116.

Figure 8:
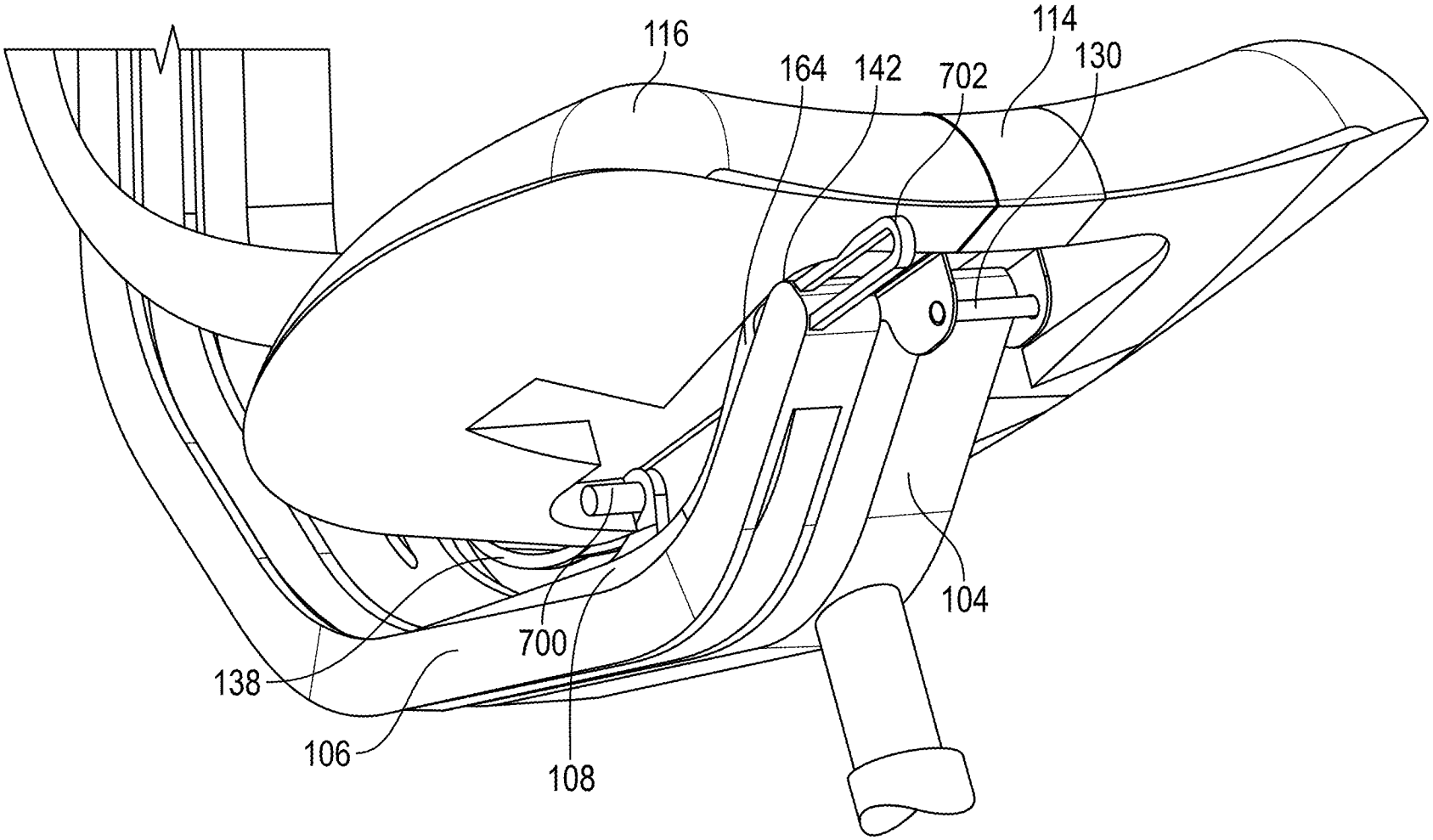
FIG. 8 illustrates an exemplary view of the first and second seat portions of the exemplary chair of FIG. 1 in an assembled position, according to an embodiment.

FIG. 8 illustrates an assembled view of the second coupling mechanism 162 (FIG. 3A) on the first end 142 of the first linkage arm 106 and the first coupling mechanism 168 (FIG. 4B) on the first end 164 of the second linkage arm 108 coupled to the connection mechanism 702 of the second seat portion 116. In the illustrated embodiment, the first seat portion 114 is coupled to the first end 130 of the linkage frame 104. The first coupling mechanism 700 of the second seat portion 116 in the illustrated embodiment is coupled to the radial cam rail mechanism 138 of the cam plate 136 (FIGS. 2A & 2B), thereby coupling the second seat portion 116 to the linkage frame 104.

Figure 9A:
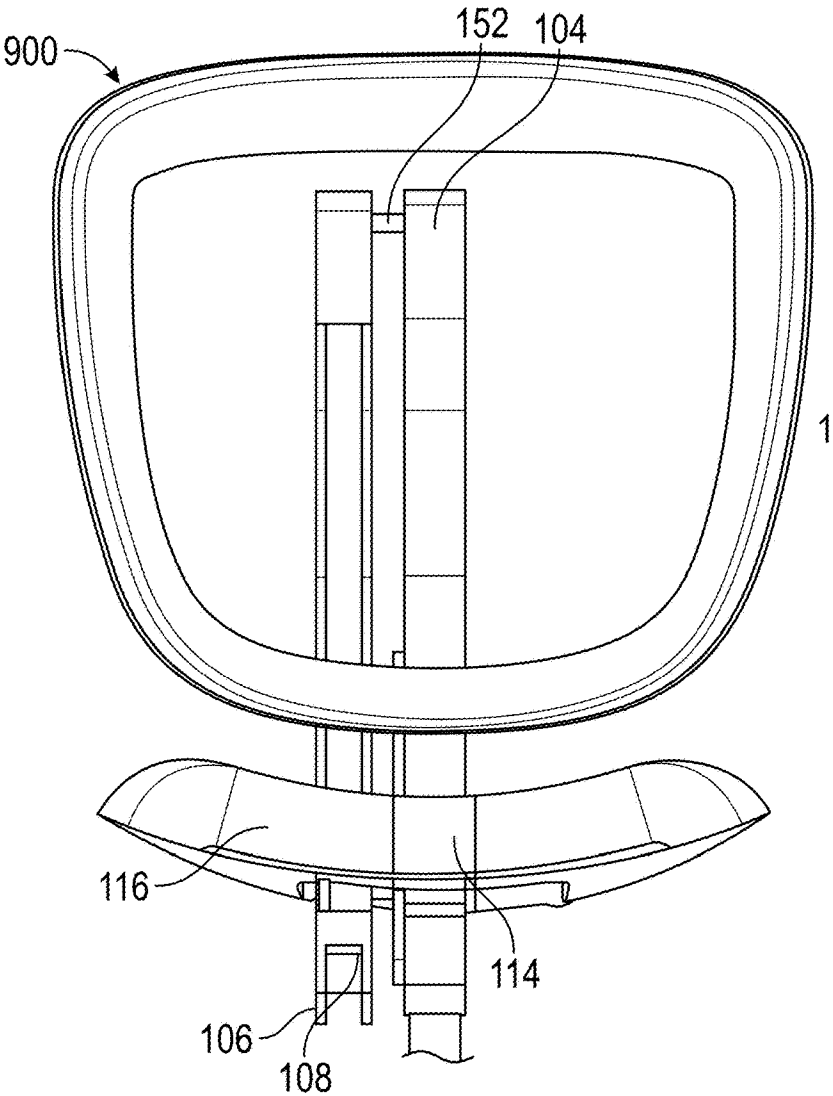
FIG. 9A illustrates an exemplary view of the exemplary chair of FIG. 1 in an assembled position, according to an embodiment.

Turning to FIG. 9A, the first seat portion 114, the second seat portion 116, the first linkage arm 106, and the second linkage arm 108 are shown in a assembled position with the linkage frame 104. In the illustrated embodiment of FIG. 9A, the second seat portion 116 is illustrated in a starting or closed position 900. In the closed position 900, the second seat portion 116 is coupled to the first seat portion 114 via the latch mechanism 604 (FIG. 6) of first seat portion 114.

Turning to FIG. 9B, the second seat portion 116 is illustrated in an ending or open position 902. In the open position 902, the second seat portion 116 is disengaged from the first seat portion 114, and the first coupling mechanism 700 of the second seat portion 116 is maneuvered to an end 904 of the radial cam rail mechanism 138. In embodiments disclosed herein, the second coupling mechanism 162 on the first end 142 of the first linkage arm 106 and the first coupling mechanism 168 on the first end 164 of the second linkage arm 108 are coupled to the connection mechanism 702 of the second seat portion 116, but are not coupled together. That is, the second coupling mechanism 162 on the first end 142 of the first linkage arm 106 and the first coupling mechanism 168 on the first end 164 of the second linkage arm 108 maneuver within the connection mechanism 702 independent of each other while the first coupling mechanism 700 of the second seat portion 116 maneuvers along the radial cam rail mechanism 138.

As shown in the illustrated embodiment of FIG. 9B, the first end 142 of the first linkage arm 106 moves along at least a portion of a length of the second seat portion 116 via the connection mechanism 702 in a first direction 704 when the second linkage arm 108 rotates about the second pivot axis 172 (FIGS. 1 and 9B) in a counter-clockwise direction (when viewed from the perspective shown in FIG. 9B) relative to the first linkage arm 106 and when the first linkage arm 106 rotates about the first pivot axis 150 (FIG. 1) in the clockwise direction (when viewed from the perspective shown in FIG. 9B) relative to the linkage frame 104. In some embodiments, the portion of the length of the second seat portion 116 corresponds to an end 708 of the second seat portion 116 where the connection mechanism 702 is positioned.

In a similar manner, the first end 142 of the first linkage arm 106 moves along at least a portion of a length of the second seat portion 116 via the connection mechanism 702 in a second direction 706 when the second linkage arm 108 rotates about the second pivot axis 172 (FIG. 1) in a clockwise direction (when viewed from the perspective shown in FIG. 9B) relative to the first linkage arm 106 and when the first linkage arm 106 rotates about the first pivot axis 150 (FIG. 1) in the counter-clockwise direction (when viewed from the perspective shown in FIG. 9B) relative to the linkage frame 104. In some embodiments, the portion of the length of the second seat portion 116 corresponds to the end 708 of the second seat portion 116 where the connection mechanism 702 is positioned. In the illustrated embodiment of FIG. 9B, the first direction 704 and the second direction 706 are opposite each other. In this embodiment, as the first coupling mechanism 700 of the second seat portion 116 moves along the radial cam rail mechanism 138 towards second end 132 of linkage arm 104, the first end 142 of the first linkage arm 106 moves away from the first end 142 of the first linkage arm 106, and as the first coupling mechanism 700 of the second seat portion 116 moves along the radial cam rail mechanism 138 towards first end 130 of linkage frame 104, the first end 142 of the first linkage arm 106 moves towards the first end 142 of the first linkage arm 106.

As shown in the illustrated embodiment of FIG. 9B, the first end 164 of the second linkage arm 108 moves along at least a portion of a length of the second seat portion 116 via the connection mechanism 702 in the second direction 706 when the second linkage arm 108 rotates about the second pivot axis 172 (FIGS. 1 and 9B) in a counter-clockwise direction (when viewed from the perspective shown in FIG. 9B) relative to the first linkage arm 106 and when the first linkage arm 106 rotates about the first pivot axis 150 (FIG. 1) in the clockwise direction (when viewed from the perspective shown in FIG. 9B) relative to the linkage frame 104. In some embodiments, the portion of the length of the second seat portion 116 corresponds to the end 708 of the second seat portion 116 where the connection mechanism 702 is positioned.

In a similar manner, the first end 164 of the second linkage arm 108 moves along at least a portion of a length of the second seat portion 116 via the connection mechanism 702 in the first direction 704 when the second linkage arm 108 rotates about the second pivot axis 172 (FIG. 1) in a clockwise direction (when viewed from the perspective shown in FIG. 9B) relative to the first linkage arm 106 and when the first linkage arm 106 rotates about the first pivot axis 150 (FIG. 1) in the counter-clockwise direction (when viewed from the perspective shown in FIG. 9B) relative to the linkage frame 104. In some embodiments, the portion of the length of the second seat portion 116 corresponds to the end 708 of the second seat portion 116 where the connection mechanism 702 is positioned. In the illustrated embodiment of FIG. 9B, the first direction 704 and the second direction 706 are opposite each other. In this embodiment, as the first coupling mechanism 700 of the second seat portion 116 moves along the radial cam rail mechanism 138 towards second end 132 of linkage arm 104, the first end 164 of the second linkage arm 108 moves away from the first end 142 of the first linkage arm 106, and as the first coupling mechanism 700 of the second seat portion 116 moves along the radial cam rail mechanism 138 towards first end 130 of linkage frame 104, the first end 142 of the first linkage arm 106 moves towards the first end 142 of the first linkage arm 106.

In the illustrated embodiment of FIG. 9B, the connection mechanism 702 is illustrated as a single rail that receives the first end 142 of the first linkage arm 106 and the first end 164 of the second linkage arm 108. In other embodiments, the connection mechanisms 702 can comprise separate rails for each of the first linkage arm 106 and the second linkage arm 108. In such an embodiment, the first end 142 of the first linkage arm 106 can be positioned in a first rail, and the first end 164 of the second linkage arm 108 can be positioned in a second rail.

Figure 10B:
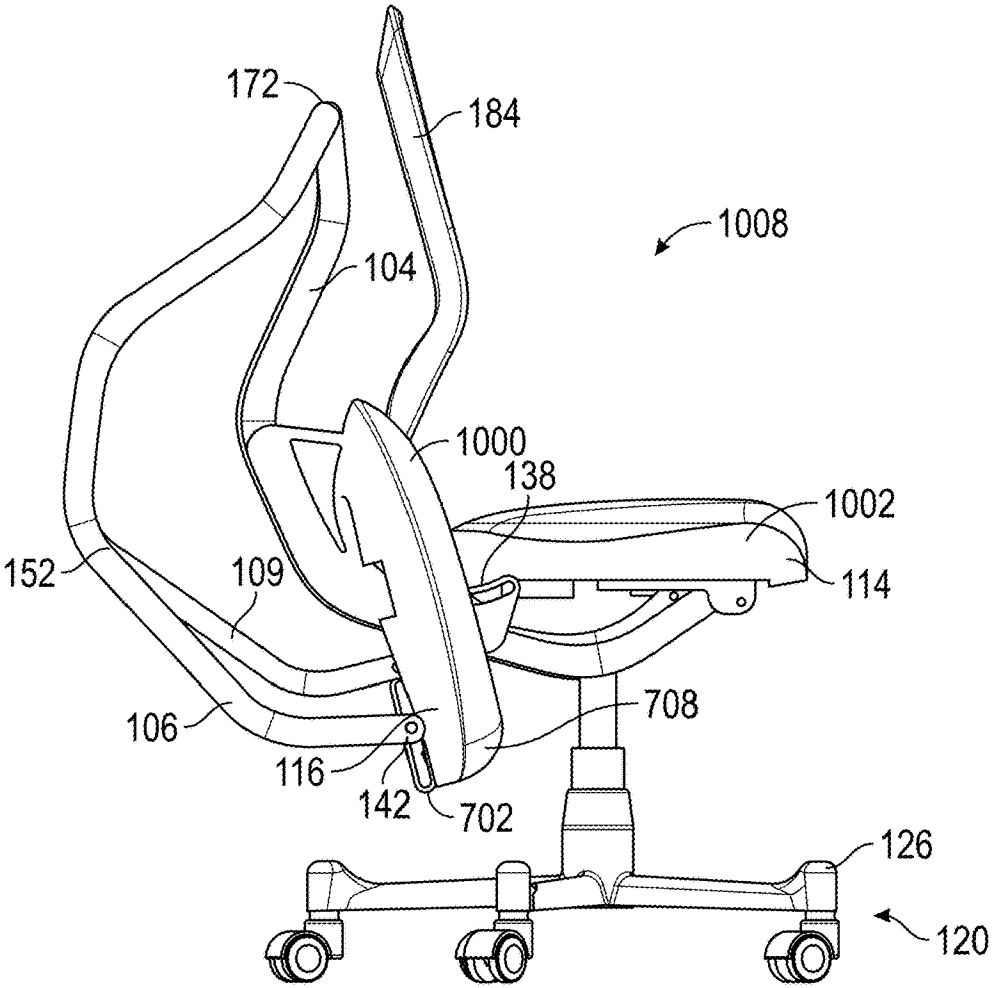
FIG. 10B illustrates an exemplary view of the exemplary chair of FIG. 1 in a second position, according to an embodiment.
Figure 10A:
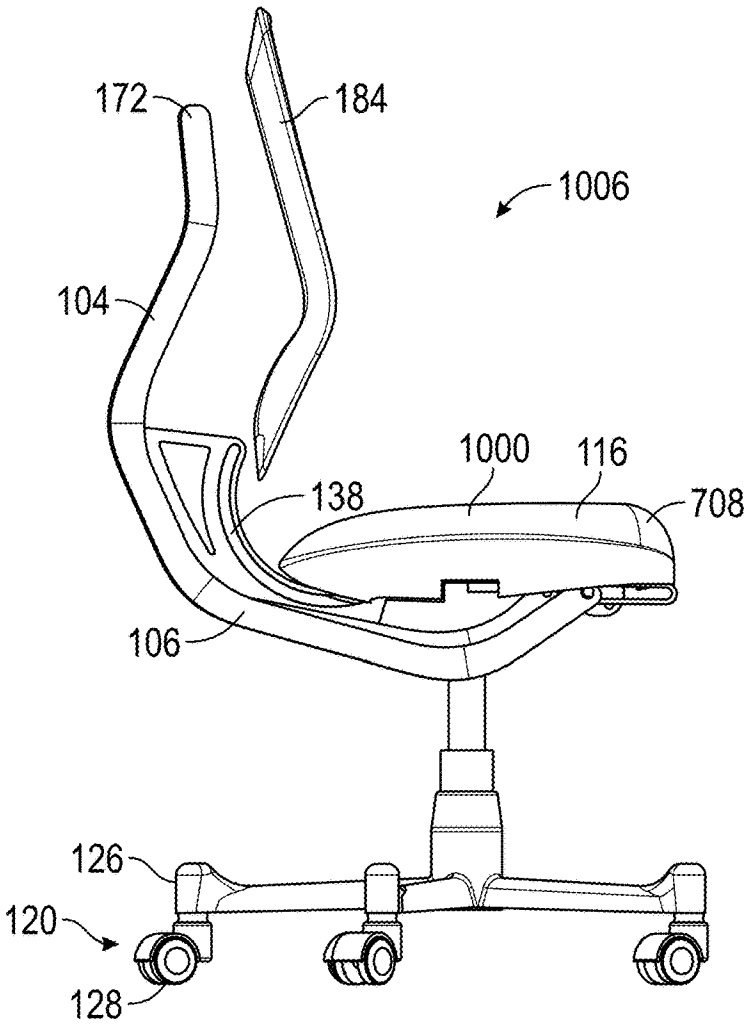
FIG. 10A illustrates an exemplary view of the exemplary chair of FIG. 1 in a first position, according to an embodiment.
Figure 10C:
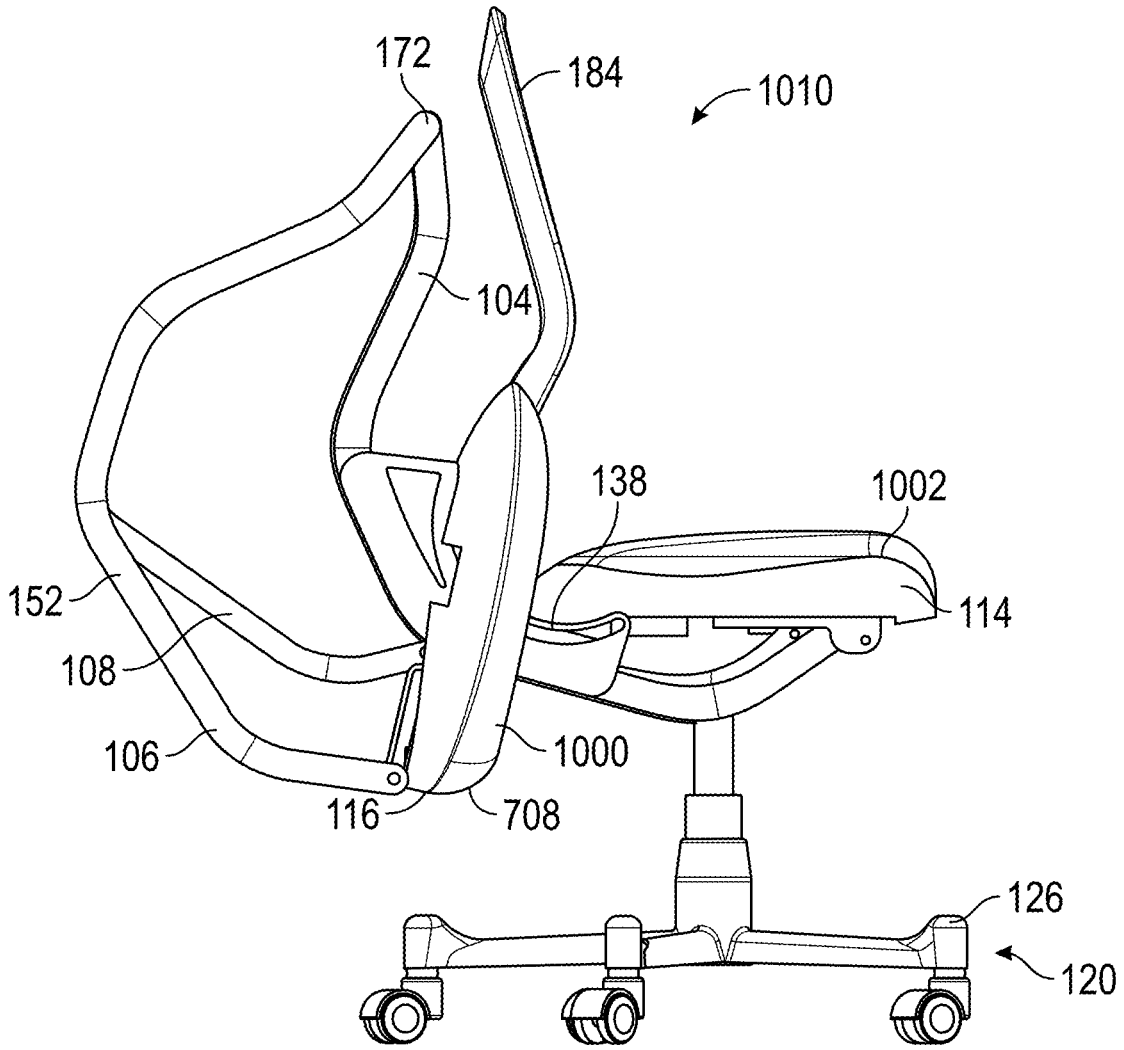
FIG. 10C illustrates an exemplary view of the exemplary chair of FIG. 1 in a third position, according to an embodiment.

Turning to FIGS. 10A-10C, a sequence of positions of the second seat portion 116 of the chair 100 are illustrated. In the illustrated embodiment of FIG. 10A, the second seat portion 116 includes a surface 1000 that is in a starting or first position 1006 relative to a surface 1002 of the first seat portion 114. As shown in the illustrated embodiment of FIG. 10A, the surface 1000 of the second seat portion 116 is on the same plane as the surface 1002 of the first seat portion 114, resulting in the surface 1000 of the second seat portion 116 being 0 degrees from the surface 1002 of the first seat portion 114.

Turning to FIG. 10B, the second seat portion 116 is in an operating or second position 1008. During operation, the latch mechanism 604 (FIG. 6) can be disengaged, and the second seat portion 116 can be operated or moved from the first position 1006 to the second position 1008 by maneuvering the first coupling mechanism 700 (FIG. 7) along the radial cam rail mechanism 138 (FIG. 1). As discussed above, moving the second seat portion 116 from the first position 1006 to the second position 1008 results in the first end 142 of the first linkage arm 106 moving along the second seat portion 116 via the connection mechanism 702 in the first direction 704 (FIG. 7) when the second linkage arm 108 rotates about the second pivot axis 172 (FIG. 1) in a counter-clockwise direction (when viewed from the perspective shown in FIG. 10) relative to the first linkage arm 106 and when the first linkage arm 106 rotates about the first pivot axis 150 (FIG. 1) in a clockwise direction (when viewed from the perspective shown in FIG. 10B) relative to the linkage frame 104. Continuing with the above embodiment, the first end 142 of the first linkage arm 106 moves along the second seat portion 116 via the connection mechanism 702 in a second direction 706 when the second linkage arm 108 rotates about the second pivot axis 172 (FIG. 9B) in a clockwise direction (when viewed from the perspective shown in FIG. 10B) relative to the first linkage arm 106 and when the first linkage arm 106 rotates about the first pivot axis 150 (FIG. 109B) in a counter-clockwise direction (when viewed from the perspective shown in FIG. 10B) relative to the linkage frame 104.

In a similar manner, moving the second seat portion 116 from the first position 1006 to the second position 1008 results in the first end 164 of the second linkage arm 108 moving along the second seat portion 116 via the connection mechanism 702 in the second direction 706 (FIG. 7) when the second linkage arm 108 rotates about the second pivot axis 172 (FIG. 1) in a counter-clockwise direction (when viewed from the perspective shown in FIG. 10) relative to the first linkage arm 106 and when the first linkage arm 106 rotates about the first pivot axis 150 (FIG. 1) in a clockwise direction (when viewed from the perspective shown in FIG. 10B) relative to the linkage frame 104. Continuing with the above embodiment, the first end 164 of the second linkage arm 108 moves along the second seat portion 116 via the connection mechanism 702 in the first direction 704 when the second linkage arm 108 rotates about the second pivot axis 172 (FIG. 9B) in a clockwise direction (when viewed from the perspective shown in FIG. 10B) relative to the first linkage arm 106 and when the first linkage arm 106 rotates about the first pivot axis 150 (FIG. 109B) in a counter-clockwise direction (when viewed from the perspective shown in FIG. 10B) relative to the linkage frame 104

In the illustrated embodiments, the second seat portion traverses a radial path based on the shape of the radial cam rail mechanism 138. In the illustrated embodiment of FIG. 10B, the surface 1000 of the second seat portion 116 in the second position 1008 has rotated approximately 76 degrees relative to the surface 1002 of the first seat portion 114 relative to the first position 1006 (FIG. 10A). In some embodiments, the surface 1000 of the second seat portion 116 can be rotated between 20-90 degrees in the second position 1008. As such, when the surface 1000 of the second seat portion 116 has rotated between 0-19 degrees, the second seat portion 116 can be considered to be in the first position 1006.

Turning to FIG. 10C, the second seat portion 116 is in an ending or third position 1010. To move from the second position 1008 to the third position 1010, the surface 1000 of the second seat portion 116 moves beyond the 90 degree range relative to the surface 1002 of the first seat portion 114. In some embodiments, the second seat portion 116 can be considered to be in the third position 1010 when the first coupling mechanism 700 (FIG. 7) of the second seat portion 116 reaches the end 904 (FIG. 9B) of the radial cam rail mechanism 138. In the illustrated embodiment of FIG. 10C, the surface 1000 of the second seat portion 116 has rotated approximately 103 degrees relative to the surface 1002 of the first seat portion 114. In some embodiments, the surface 1000 of the second seat portion 116 can be rotated between 91-110 degrees in the third position 1010. As such, when the surface 1000 of the second seat portion 116 has rotated between 0-19 degrees the second seat portion 116 can be considered to be in the first position 1006, when the surface 1000 of the second seat portion 116 has rotated between 20-90 degrees the second seat portion 116 can be considered to be in the second position 1008, and when the surface 1000 of the second seat portion 116 has rotated between 91-110 degrees the second seat portion 116 can be considered to be in the third position 1010.

To ease maneuvering the second seat portion 116 from the first position 1006 to the third position 1010, the wheel assemblies 120 are sized to avoid contact with the second seat portion 116. In some embodiments, the wheel assemblies 120 are positioned at least a minimum distance away from the first linkage arm 106 when second seat portion 116 is in the second position 1008 (FIG. 10B) to enable the second seat portion 116 to actuate relative to the first seat portion 114 to and position the second seat portion 116 adjacent a rear surface of the backrest 184. For example, the first end 126 of the wheel assemblies 120 can be positioned at least 12 inches (30.5 centimeters) from the first linkage arm 106 when the second seat portion 116 is in the second position 1008 (FIG. 10B). In other embodiments, the second seat portion 116 can be actuated relative to the first seat portion 114 to position the second seat portion 116 past a rear surface of the backrest 184, substantially parallel to the rear surface of the backrest 184, or adjacent a front surface of the backrest 184.

To enable a user to efficiently utilize the chair 100, the end 708 of the second seat portion 116 is positioned away from the first end of the wheel assemblies 120 when the second seat portion 116 is in the second position 1008 (FIG. 10B) or third position 1010 (FIG. 10C). For example, the end 708 of the second seat portion 116 is positioned at least 8 inches (20.3 centimeters) away from the first end 126 of the wheel assemblies 120 when the second seat portion 116 is in the third position 1010.

Returning briefly to FIG. 1, the third seat portion 118, the third linkage arm 110, and the fourth linkage arm 112 are similar in size and shape and operate in a similar manner as the second seat portion 116, the first linkage arm 106, and the second linkage arm 108, respectively, as described above. In some embodiments, the third seat portion 118, the third linkage arm 110, and the fourth linkage arm 112 are coupled together and to the linkage frame 104 in a manner similar to (but in a mirrored configuration to) how the second seat portion 116, the first linkage arm 106, and the second linkage arm 108 are coupled together and to the linkage frame 104. The backrest 184 is coupled to the linkage frame 104 via a coupling mechanism (e.g., fasteners, snap fit connection, etc.).

Referring back to FIGS. 10A-10C, during operation of the chair 1000, a user can sit in the chair 100 in in the first position 1006 (FIG. 10A) and may desire to perform a stretching movement. To perform the stretching movement, the user can disengage the latch mechanism 604 (FIG. 6) and begin to maneuver the second seat portion 116 from the first position 1006 (FIG. 10A), to the second position 1008 (FIG. 10B), and finally to the third position 1010 (FIG. 10C). In some embodiments, this maneuvering can be performed using the user's right leg while the user remains seated in the chair 1000. Once the user has positioned the second seat portion 116 in the third position 1010 (FIG. 10C), the user can perform the stretching movement. Once the user has completed the stretching movement, the user can maneuver the second seat portion 116 back to the first position 1006 (FIG. 10A). In embodiments disclosed herein, the second seat portion 116 is biased toward the first position 1006 (FIG. 10A) via the biasing element 152 (FIG. 1) to assist the user with maneuvering the second seat portion 116 back to the first position 1006 (FIG. 10A). In some embodiments, this biasing allows the user to remain seated in the chair 1000 while the second seat portion 116 is maneuvered back to the first position 1106 (FIG. 10A). In a similar manner, the user can then perform the same sequence on the third seat portion 118 to perform a stretching movement on the user's left leg. This process enables the user to relieve back pain and to improve the user's posture.

Figure 11B:
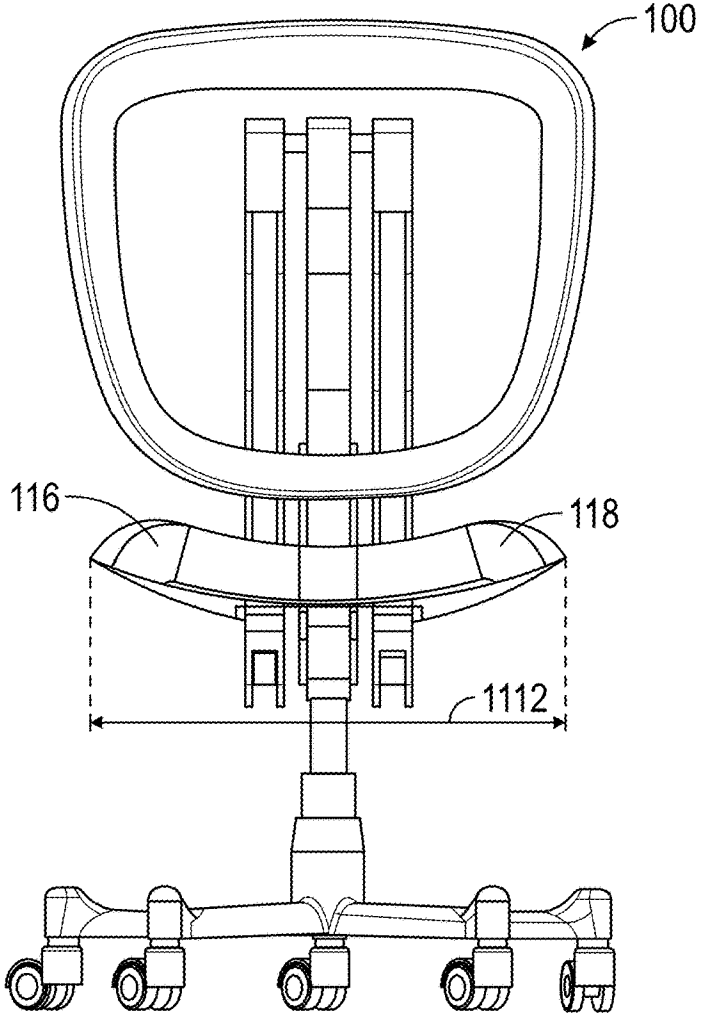
FIG. 11B illustrates exemplary dimensions for the exemplary chair of FIG. 1, according to an embodiment.
Figure 11A:
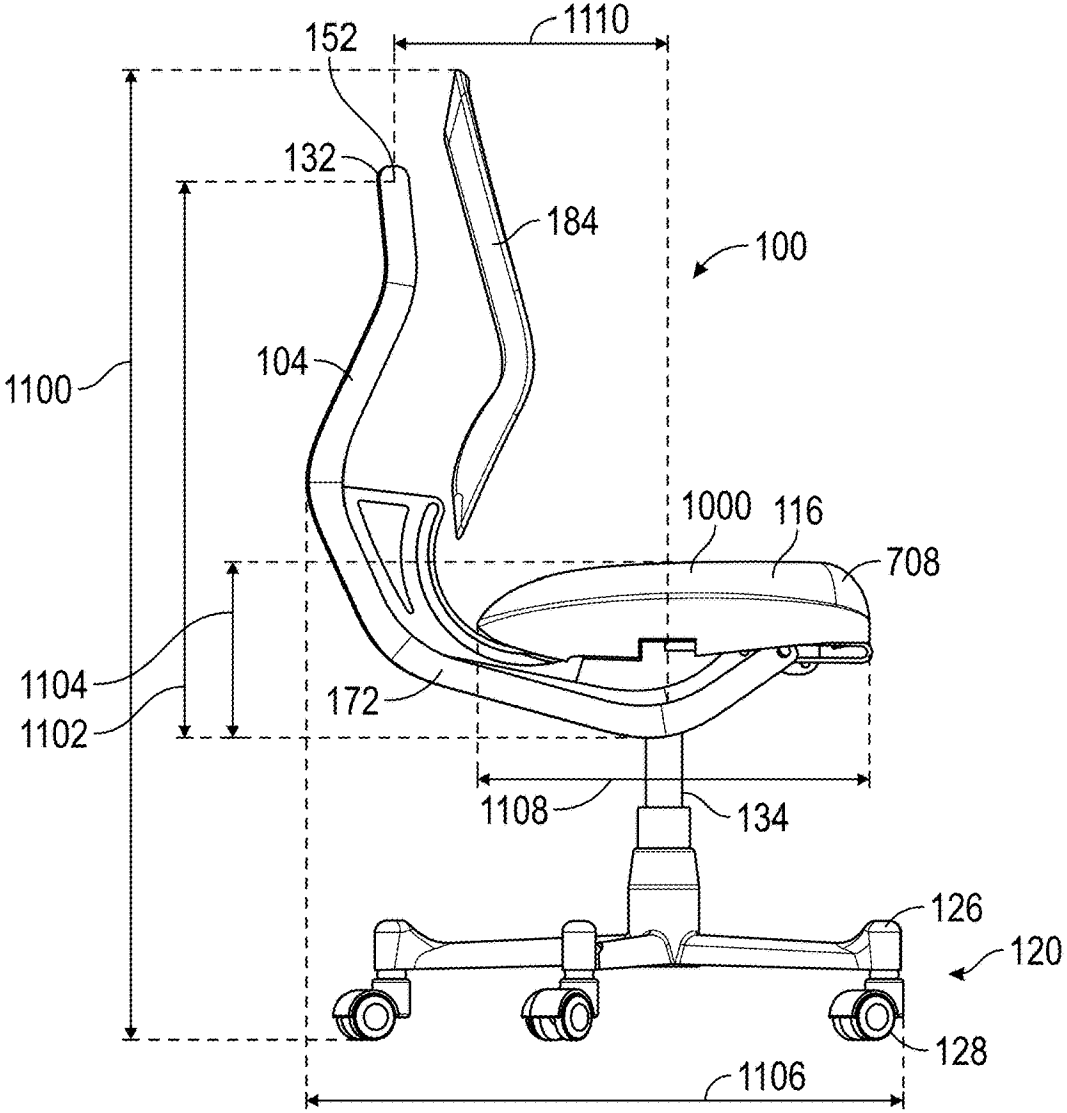
FIG. 11A illustrates exemplary dimensions for the exemplary chair of FIG. 1, according to an embodiment.
Figure 11C:
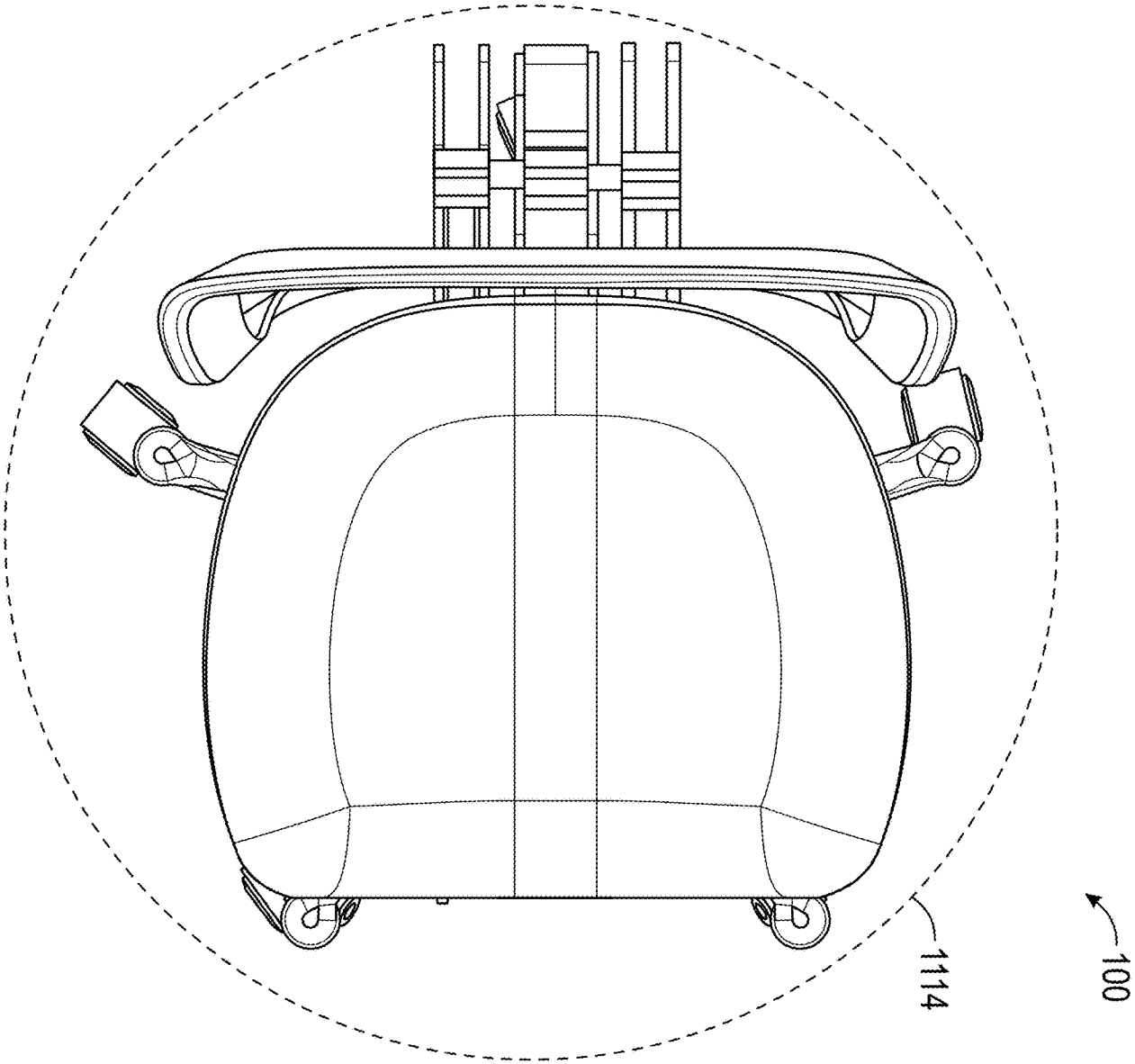
FIG. 11C illustrates exemplary dimensions for the exemplary chair of FIG. 1, according to an embodiment.

Turning to FIGS. 11A-11C, exemplary dimensions are illustrated for the chair 100. As shown in FIG. 11A, the chair 100 includes a first dimension 1100 that extends from the top of the backrest 184 to the second end 128 of the wheel assemblies 120. In some embodiments, the first dimension 1100 can be sized in a range between 30-50 inches (76.2-127 centimeters). The chair 100 of the illustrated embodiment includes a second dimension 1102 that extends from the second end 132 of the linkage frame 104 to the top of the coupling mechanism 134 of the linkage frame 104. In some embodiments, the second dimension can be sized in a range between 15-35 inches (38.1-88.9 centimeters). The chair 100 of the illustrated embodiment includes a third dimension 1104 that extends from the surface 1000 of the second seat portion 116 in the first position 1006 (FIG. 10A) to the top of the coupling mechanism 134 of the linkage frame 104. In some embodiments, the third dimension is sized in a range between 4-20 inches (10.16-50.8 centimeters). The chair 100 of the illustrated embodiments includes a fourth dimension 1106 that extends from a rear surface of the linkage frame 104 to a forward surface of the wheel assemblies 120 in the position illustrated in FIG. 11A. In some embodiments, the fourth dimension 1106 is sized in a range between 15-40 inches (38.1-101.6 centimeters). The chair 100 of the illustrated embodiments includes a fifth dimension 1108 that corresponds to a length of the second seat portion 116 (and the first seat portion 114 and third seat portion 118). In some embodiments, the fifth dimension is sized in a range between 10-25 inches (25.4-63.5 centimeters). The chair 100 of the illustrated embodiments includes a sixth dimension 1110 that extends from the second end 132 of the linkage frame 104 to a center mark of the coupling mechanism 134 of the linkage frame 104 in the position illustrated in FIG. 11A. In some embodiments, the sixth dimension 1110 can be sized in a range between 5-30 inches (12.7-76.2 centimeters). Turning to FIG. 11B, the chair 100 of the illustrated embodiments includes a seventh dimension 1112 that extends from a side of the second seat portion 116 to a side of the third seat portion 118. In some embodiments, the seventh dimension 1112 can be sized in a range between 12-30 inches (30.48-

76.2 centimeters). The chair 100 of the illustrated embodiments also includes an eighth dimension 1114 that corresponds to a circumference of the chair 100 in the position illustrated in FIG. 11C. In some embodiments, the eighth dimension 1114 can be sized in a range between 18-40 inches (45.72-101.6 centimeters).

Figure 12:
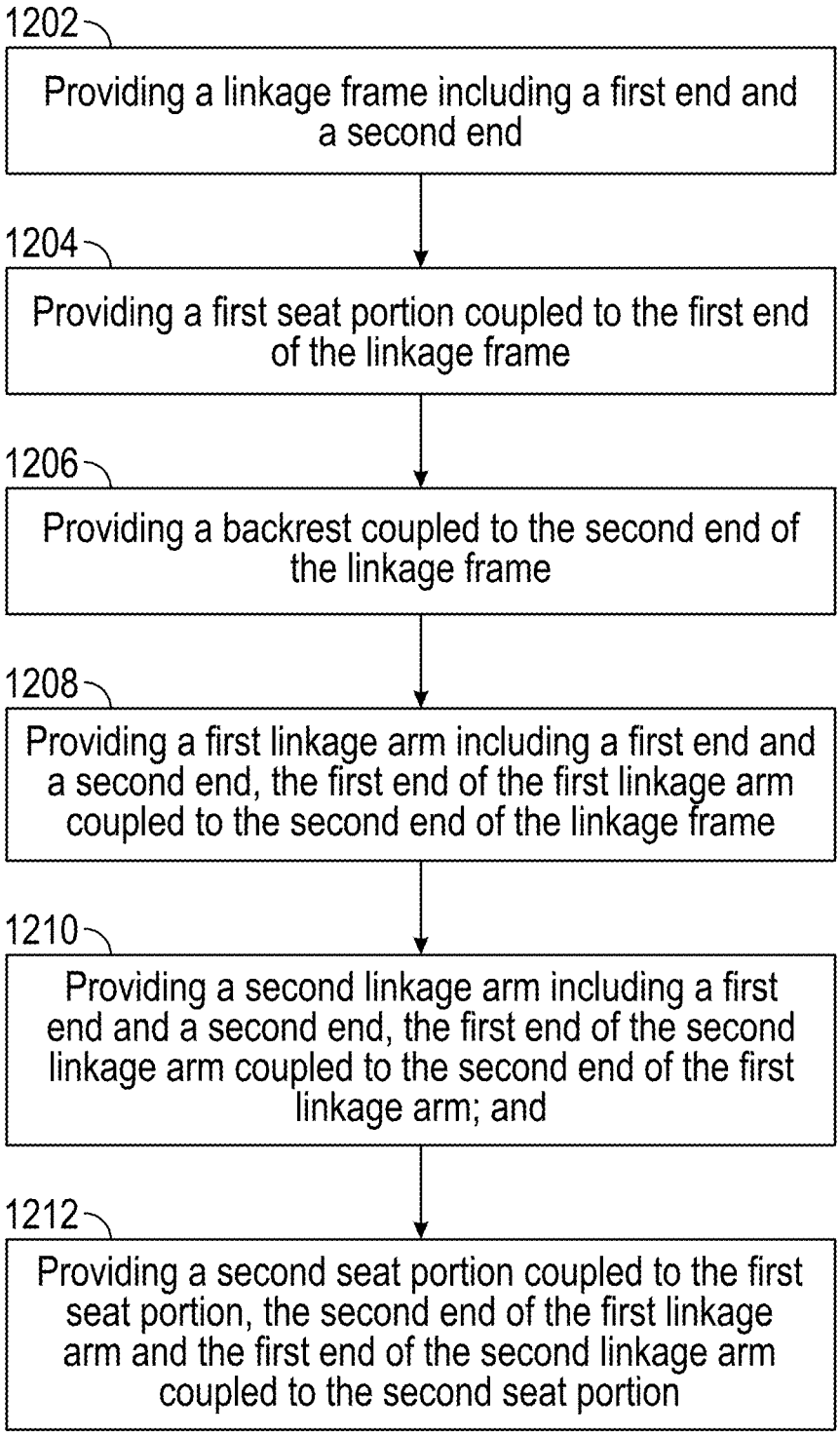
FIG. 12 illustrates a flow chart of a method for manufacturing a chair, according to an embodiment.

FIG. 12 illustrates a flowchart of a method (1200) for manufacturing a chair (e.g., chair 100 (FIG. 1), according to certain embodiments. As an example, the chair manufactured using the method 1200 can be similar or identical to the chair 100 (FIG. 1).

In a number of embodiments, the method 1200 can include providing a linkage frame including a first end and a second end (block 1202). For example, the method 1200 can include providing the linkage frame 104 (FIG. 1) including the first end 130 (FIG. 1) and the second end 132 (FIG. 1). In some embodiments, the method 1200 can include providing a cam plate 136 (FIG. 1) positioned between the first end 130 (FIG. 1) and the second end 132 (FIG. 1) of the linkage frame 104 (FIG. 1). In some embodiments, the cam plate 136 (FIG. 1) includes a radial cam rail mechanism 138 (FIG. 1) extending along at least a portion of a length of the cam plate 136 (FIG. 1).

In a number of embodiments, the method 1200 can include providing a first seat portion coupled to the first end of the linkage frame (block 1204). For example, the method 1200 can include providing the first seat portion 114 (FIG. 1) coupled to the first end 130 (FIG. 1) of the linkage frame 104 (FIG. 1).

In a number of embodiments, the method 1200 can include providing a backrest coupled to the second end of the linkage frame (block 1206). For example, the method 1200 can include providing the backrest 184 (FIG. 1) coupled to the linkage frame 104 (FIG. 1).

In a number of embodiments, the method 1200 can include providing a first linkage arm including a first end and a second end, the first end of the first linkage arm coupled to the second end of the linkage frame (block 1208). For example, the method 1200 can include providing the first linkage arm 106 (FIG. 1) including the first end 142 (FIG. 1) and the second end 144 (FIG. 1), where the first end 142 (FIG. 1) of the first linkage arm 106 (FIG. 1) is coupled to the second end 132 (FIG. 1) of the linkage frame 104 (FIG. 1).

In a number of embodiments, the method 1200 can include providing a second linkage arm including a first end and a second end, the first end of the second linkage arm coupled to the second end of the first linkage arm (block 1210). For example, the method 1200 can include providing the second linkage arm 108 (FIG. 1) including the first end 164 (FIG. 1) and the second end 166 (FIG. 1) where the first end 164 (FIG. 1) of the second linkage arm 108 (FIG. 1) is coupled to the first linkage arm 106 (FIG. 1) in the cavity 158 (FIG. 1) of the first linkage arm 106 (FIG. 1).

In a number of embodiments, the method 1200 can include providing a second seat portion coupled to the first seat portion, the first end of the first linkage arm and the first end of the second linkage arm coupled to the second seat portion (block 1212). For example, the method 1200 can include providing the second seat portion 116 (FIG. 1) coupled to the first seat portion 114 (FIG. 1) via the latch mechanism 604 (FIG. 6), and the first end 142 (FIG. 1) of the first linkage arm 106 (FIG. 1) and the first end 164 (FIG. 1) of the second linkage arm 108 (FIG. 1) are coupled to the second seat portion 116 (FIG. 1) via the connection mechanism 702 (FIG. 7). In some embodiments, providing the second seat portion 116 (FIG. 1) comprises providing a first coupling mechanism 700 (FIG. 7) (e.g., a protrusion extending from a surface of the second seat portion 116 (FIG. 1)). In some embodiments, the protrusion is adapted to move along the radial cam rail mechanism 138 (FIG. 1).

Although ergonomic chairs have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any components of the ergonomic chair disclosed herein, as well as the steps to manufacture the chair, may be modified, and that the foregoing discussion of certain of these embodiments does not necessarily represent a complete description of all possible embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An apparatus comprising:

a base mount;

a linkage frame including a first end and a second end, the first end of the linkage frame coupled to the base mount, the linkage frame including a cam plate positioned between the first end and the second end;

a first linkage arm including a first end and a second end, the second end of the first linkage arm rotatably coupled to the second end of the linkage frame, the first linkage arm including a cavity; and a second linkage arm including a first end and a second end, the second end of the second linkage arm coupled to the first linkage arm, the second linkage arm positioned in the cavity of the first linkage arm.

2. The apparatus of claim 1, wherein:

the second end of the first linkage arm includes a first coupling mechanism;

the second end of the linkage frame comprises a second coupling mechanism; and the first and second coupling mechanisms couple together to define a first pivot axis about which the first linkage arm rotates relative to the linkage frame.

3. The apparatus of claim 2, further comprising:

a biasing element coupled to at least one of the first or second coupling mechanism to bias the first linkage arm.

4. The apparatus of claim 2, wherein:

the first linkage arm further includes a third coupling mechanism located between the first and second ends of the first linkage arm;

the second linkage arm includes a fourth coupling mechanism located at the second end of the second linkage arm; and the third coupling mechanism couples to the fourth coupling mechanism to define a second pivot axis about which the second linkage arm rotates relative to the first linkage arm.

5. The apparatus of claim 1, further comprising:

a first seat portion coupled to the first end of the linkage frame; and a second seat portion coupled to the first end of the first linkage arm and the first end of the second linkage arm.

6. The apparatus of claim 5, wherein:

the first end of the first linkage arm is coupled to the second seat portion via a first connection mechanism; and the first end of the second linkage arm is coupled to the second seat portion via a second connection mechanism.

7. The apparatus of claim 6, wherein:

the first end of the first linkage arm moves along at least a portion of a length of the second seat portion via the first connection mechanism in a first direction when the second linkage arm rotates about a second pivot axis relative to the first linkage arm and when the first linkage arm rotates about a first pivot axis relative to the linkage frame; and the first end of the second linkage arm moves along at least a portion of a length of the second seat portion via the second connection mechanism in a second direction when the second linkage arm rotates about the second pivot axis relative to the first linkage arm and when the first linkage arm rotates about the first pivot axis relative to the linkage frame.

8. The apparatus of claim 5, wherein:

the first seat portion and the second seat portion are coupled together via a latch mechanism; and the latch mechanism, when disengaged, enables the second seat portion to actuate relative to the first seat portion.

9. The apparatus of claim 8, wherein:

the second seat portion is adapted to move between 0 degrees and over 100 degrees relative to a surface of the first seat portion; and the second seat portion is adapted to remain fixed at approximately 75 degrees or at approximately 100 degrees relative to the surface of the first seat portion when the latch mechanism is engaged.

10. The apparatus of claim 1, wherein:

the base mount further includes wheel assemblies; and each of the wheel assemblies include a first end and a second end.

11. The apparatus of claim 10, wherein, when the apparatus is fully assembled, the first ends of the wheel assemblies and the base mount are positioned at least a minimum distance away from the first end of the first linkage arm to enable the first end of the first linkage arm to move between the first end of the linkage frame and the first end of at least one of the wheel assemblies.

12. The apparatus of claim 11, further comprising:

a third linkage arm including a first end and a second end, the second end of the third linkage arm rotatably coupled to the second end of the linkage frame, the third linkage arm including a cavity; and a fourth linkage arm including a first end and a second end, the second end of the fourth linkage arm coupled to the third linkage arm, the fourth linkage arm positioned in the cavity of the third linkage arm.

13. The apparatus of claim 12, further comprising:

a first seat portion coupled to the first end of the linkage frame;

a second seat portion coupled to the first end of the first linkage arm and the first end of the second linkage arm; and a third seat portion coupled to the first end of the third linkage arm and the first end of the fourth linkage arm.

14. A chair comprising:

a linkage frame including a first end, a second end, and a cam plate positioned between the first end and the second end, the cam plate including a radial cam rail mechanism extending along at least a portion of a length of the cam plate;

a first seat portion coupled to the first end of the linkage frame;

a backrest coupled to the second end of the linkage frame;

a first linkage arm including a first end and a second end, the second end of the first linkage arm rotatably coupled to the second end of the linkage frame, the first linkage arm including a cavity;

a second linkage arm including a first end and a second end, the second end of the second linkage arm coupled to the first linkage arm, the second linkage arm positioned in the cavity of the first linkage arm; and a second seat portion coupled to the first end of the first linkage arm, coupled to the first end of the second linkage arm, and configured to move along the radial cam rail mechanism.

15. The chair of claim 14, further comprising a base mount coupled to the linkage frame, the base mount including a plurality of wheels positioned at least a minimum distance away from the first linkage arm to enable the second seat portion to actuate relative to the first seat portion to position the second seat portion adjacent a rear surface of the backrest.

16. The chair of claim 14, wherein:

the first end of the first linkage arm moves along at least a portion of a length of the second seat portion in a first direction when the second linkage arm rotates relative to the first linkage arm and when the first linkage arm rotates relative to the linkage frame; and the first end of the second linkage arm moves along at least a portion of a length of the second seat portion in a second direction when the second linkage arm rotates relative to the first linkage arm and when the first linkage arm rotates relative to the linkage frame.

17. The chair of claim 14, further comprising:

a third linkage arm including a first end and a second end, the second end of the third linkage arm rotatably coupled to the second end of the linkage frame, the third linkage arm including a cavity;

a fourth linkage arm including a first end and a second end, the second end of the fourth linkage arm coupled to the third linkage arm, the fourth linkage arm positioned in the cavity of the third linkage arm; and a third seat portion coupled to the first end of the third linkage arm, coupled to the first end of the fourth linkage arm, and configured to move along the radial cam rail mechanism.

18. A method of manufacturing an apparatus, the method comprising:

providing a linkage frame including a first end and a second end;

providing a first seat portion coupled to the first end of the linkage frame;

providing a backrest coupled to the second end of the linkage frame;

providing a first linkage arm including a first end and a second end, the first end of the first linkage arm coupled to the second end of the linkage frame;

providing a second linkage arm including a first end and a second end, the first end of the second linkage arm coupled to the first end of the first linkage arm; and providing a second seat portion coupled to the first seat portion, the first end of the first linkage arm and the first end of the second linkage arm coupled to the second seat portion.

19. The method of claim 18, further comprising providing a cam plate positioned between the first end and the second end of the linkage frame, wherein the cam plate includes a radial cam rail extending along at least a portion of a length of the cam plate.

20. The method of claim 19, wherein providing the second seat portion comprises providing a protrusion extending from a surface of the second seat portion, the protrusion to be moved along the radial cam rail.

* * * * *